US007665895B2

(12) United States Patent
Takita et al.

(10) Patent No.: US 7,665,895 B2
(45) Date of Patent: Feb. 23, 2010

(54) BAG HAVING A DEFORMABLE MEMBER ATTACHED THERETO

(75) Inventors: Masanori Takita, Tokyo (JP); Hiroshi Yashima, Tokyo (JP); Michiaki Fujita, Tokyo (JP); Tomoaki Shimazu, Tokyo (JP); Motomitsu Hasumi, Wakayma (JP); Hiroshi Nishimura, Wakayama (JP)

(73) Assignee: Kao Corporation, Tokyo (JP)

( * ) Notice: Subject to any disclaimer, the term of this patent is extended or adjusted under 35 U.S.C. 154(b) by 514 days.

(21) Appl. No.: 10/824,539

(22) Filed: Apr. 15, 2004

(65) Prior Publication Data

US 2004/0234175 A1 Nov. 25, 2004

(30) Foreign Application Priority Data

| | | |
|---|---|---|
| Apr. 18, 2003 | (JP) | 2003-114912 |
| Sep. 12, 2003 | (JP) | 2003-320942 |
| Sep. 18, 2003 | (JP) | 2003-326883 |
| Oct. 1, 2003 | (JP) | 2003-343221 |
| Oct. 1, 2003 | (JP) | 2003-343222 |
| Oct. 1, 2003 | (JP) | 2003-343223 |
| Dec. 24, 2003 | (JP) | 2003-427475 |

(51) Int. Cl.
*B65D 33/30* (2006.01)

(52) U.S. Cl. ..... 383/88; 383/2; 383/107; 383/120; 383/905

(58) Field of Classification Search ..... 383/88, 383/207, 202, 2, 107, 120, 905
See application file for complete search history.

(56) References Cited

U.S. PATENT DOCUMENTS

| | | | | |
|---|---|---|---|---|
| 1,903,839 | A * | 4/1933 | Royal | 383/89 |
| 2,020,804 | A * | 11/1935 | Segal | 383/89 |
| 2,912,102 | A * | 11/1959 | Scott | 206/393 |
| 3,228,584 | A * | 1/1966 | Ashton | 383/203 |
| 3,269,642 | A * | 8/1966 | Cvacho | 206/525 |
| 3,290,854 | A * | 12/1966 | McMurray | 53/417 |
| 3,297,233 | A * | 1/1967 | Meyerhoefer | 55/375 |
| 3,462,067 | A * | 8/1969 | Shore | 383/104 |
| 3,508,374 | A * | 4/1970 | Bertoglio | 53/410 |
| 3,537,636 | A | 11/1970 | Rochette | |
| 4,877,337 | A * | 10/1989 | Wood | 383/21 |
| 6,238,090 | B1 * | 5/2001 | Yuter | 383/2 |
| 6,422,752 | B1 | 7/2002 | Hoffner et al. | |

FOREIGN PATENT DOCUMENTS

| | | |
|---|---|---|
| JP | 49-12112 | 2/1974 |

(Continued)

OTHER PUBLICATIONS

U.S. Appl. No. 29/214,477, filed Oct. 5, 2004, Yashima et al.

*Primary Examiner*—Nathan J Newhouse
*Assistant Examiner*—Jack H Morgan, Jr.
(74) *Attorney, Agent, or Firm*—Oblon, Spivak, McClelland, Maier & Neustadt, L.L.P.

(57) ABSTRACT

A bag formed of a sheet material adapted to be filled with contents and opened at the top for taking out the contents. The bag has fused joints along the lateral edges thereof. A plastically deformable wire-like member is attached inside the fused joints over a length from the output opening side portion to the body portion.

12 Claims, 16 Drawing Sheets

FOREIGN PATENT DOCUMENTS

| | | |
|---|---|---|
| JP | 51-46372 | 11/1976 |
| JP | 53-16507 | 5/1978 |
| JP | 53-72610 | 6/1978 |
| JP | 59-124268 | 7/1984 |
| JP | 61-142123 | 6/1986 |
| JP | 2-242750 | 9/1990 |
| JP | 4-19439 | 2/1992 |
| JP | 07-002260 | 1/1995 |
| JP | 08-244795 | 9/1996 |
| JP | 10-119982 | 5/1998 |
| JP | 11-100048 | 4/1999 |
| JP | 2000-72159 | 3/2000 |
| JP | 2000-326996 | 11/2000 |
| JP | 2000-335596 | 12/2000 |
| JP | 2001-48193 | 2/2001 |
| JP | 2003-128083 | 5/2003 |

* cited by examiner

BAG HAVING A DEFORMABLE MEMBER ATTACHED THERETO

FIELD OF THE INVENTION

The present invention relates to a bag.

BACKGROUND OF THE INVENTION

Known bags formed of one or more sheet materials include pouches and gusset bags. A gusset bag, for example, has a front face, a rear face (the front face and the rear face will hereinafter be inclusively referred to as main faces), and a pair of gusseted side faces that are inwardly folding into a V-shape. A gusset bag is flat with its side faces folded in. The folded side faces are unfolded to widen the rectangular top's opening, through which contents can be inserted and removed.

Some bags are designed to be re-closable and re-openable so that the contents may not be exposed when the contents are being stored and the contents may be taken out when needed. For example, a crease is provided across the main faces near the opening, along which the upper part of the bag can be folded back, or a tab with a string is attached to the upper end of one of the main faces so that the string may be wound around a button attached to the upper end of the other face to close the opening.

For facilitating and ensuring re-opening and re-closing a bag with contents, proposals have been made. For example, JP-A-2000-72159 discloses a gusset bag formed of waterproof kraft paper and having a piece of metal (e.g., aluminum) for the closure provided near the opening of the bag along the vertical direction, and JP-A-U-49-12112 discloses a gusset bag formed of paper, plastics, etc. and having a piece of metal such as a wire or ribbon provided as a closure along the opening edge of one or both of the main faces and along the side edge of the main faces.

There is also proposed side-gusseted trash bags, including a garbage bag having a thin metal ribbon or wire provided along the opening edge of each side face (see, for example, JP-B-U-51-46372) and a waste disposable bag having a fastening member provided at the four corners thereof whereby the four corners of the bag are fastened to a supporting frame formed of wire, etc. (see, for example, JP-A-61-142123).

JP-B-U-53-16507 proposes a closable bag for an article having a flexible wire attached to the upper part thereof in an inverted V letter shape as a clamping member, with which the opening of the bag can be closed.

In manufacturing closable bags with a plastically deformable wire-like member attached near the opening edge thereof, attachment of the wire-like member is generally carried out by a method in which overlapping ends of a folded film (sheeting) are joined together by heat sealing or with an adhesive with a plastic metal member inserted therebetween (see JP-A-11-100048 and JP-A-2000-72159) and a method in which an adhesive tape having a plastic metal member stuck thereto is attached to an arbitrary position of a bag (see JP-A-11-100048).

Where a bag is to be repeatedly opened and closed to take out the contents when necessary, various proposals have been made for keeping the opening wide in defiance of the V-folds of the side faces (see, for example, JP-A-8-244795).

SUMMARY OF THE INVENTION

The present invention provides a bag formed of a sheet material and having a plastically deformable wire-like member attached along a lateral edge thereof, the wire-like member being disposed inside a fused joint of a folded back hem seal along the lateral edge.

The present invention also provides a bag formed of a sheet material and having a plastically deformable wire-like member attached along a lateral edge thereof. The lateral edge has a hem seal formed by heat sealing, and the wire-like member is disposed inside the fused joint of the hem seal with a non-fused portion left between the wire-like member and the surrounding fused portion of the hem seal.

The present invention also provides a package product having a powdered or granular detergent packed in the bag.

BRIEF DESCRIPTION OF THE DRAWING

FIG. 2(*b*) is a perspective of the gusset bag of FIG. 2 with its upper end open.

FIG. 10(*b*) is a perspective of the gusset bag of FIG. 10(*a*) with its upper end open.

FIG. 14 is a plan of the gusset bag of FIG. 13, in which the wire-like members inserted in respective tubular holders are seen through.

FIG. 16 is a side view of a gusset bag according a sixth preferred embodiment of the invention, in which wire-like members inserted in their respective tubular holders are seen through.

FIG. 24(*b*) is a perspective of the gusset bag of FIG. 24(*a*) with its upper end open.

FIG. 30(*b*) is a fragmentary perspective showing an edge joined hem seal formed along a lateral edge of a bag, with a plastically deformable vertical wire-like member disposed inside the joint of the hem seal.

FIG. 31(*b*) is a fragmentary perspective showing an edge joined hem seal formed along a lateral edge of a bag, inside the fused joint of which is disposed a plastically deformable vertical wire-like member while the portion around the wire-like member is left non-fused.

FIG. 32(*b*) is a fragmentary perspective showing an edge joined hem seal formed along a lateral edge of a bag so as to form a tubular holder inside the hem joint, in which holder a vertical wire-like member is inserted.

DETAILED DESCRIPTION OF THE INVENTION

Figure 1:
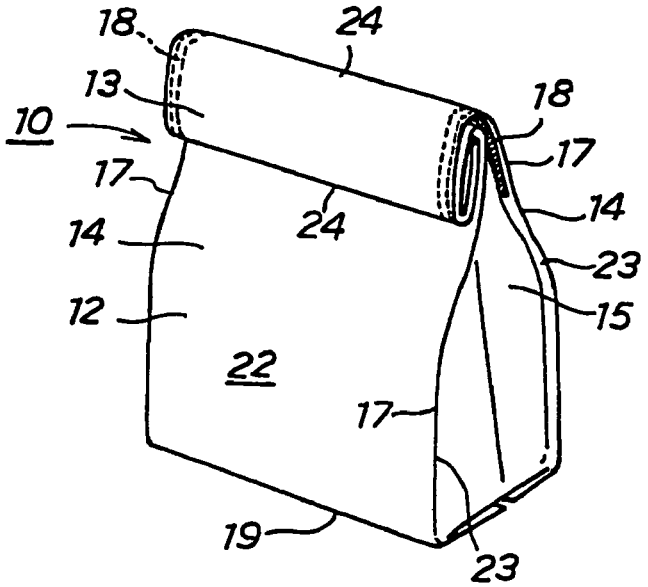
FIG. 1 is a perspective of a gusset bag according to a first preferred embodiment of the invention.

Bags such as gusset bags have broad applications with improvements in sheet materials, forms of the bags, and the like. For instance, self-standing gusseted packages of a powdered or granular detergent, etc. with the upper end opening sealed are commercially supplied. A user cuts off the seal of the package to make an upper end output opening, through which to take out a necessary amount of the detergent when needed. For these applications, the gusset bags should be designed so that the outlet opening after cutting the seal may be re-closed easily and also re-opened widely for easily taking out the detergent, etc.

The gusset bags disclosed in JP-A-2000-72159 and JP-A-U-49-12112 are simple paper or plastic bags that are folded flat before use and, upon use, expanded by unfolding the folded side faces for allowing a user to put in something through the thus widened rectangular opening. When these gusset bags are used as a container for packaging a commercial product, such as a powder detergent, various problems occur. That is, the gusset bag of JP-A-2000-72159 is a small-sized kraft paper bag that is to be placed in an automobile for putting trash or vomit in. The piece of metal (e.g., aluminum) attached to the bag is only for closing the bag but not contemplated to make the bag self-stand and stay open by itself for enabling a user to take out the contents from it. The gusset bag of JP-A-U-49-12112 is a paper or plastic bag having a closure metal piece attached along the opening edge. After some article is put into this bag, the opening can be closed simply by folding the closure metal piece without using a paper seal, etc. This design is not intended to make it easy to take out the contents from a self-standing bag.

The garbage bag and the waste disposable bag disclosed in JP-B-U-51-46372 and JP-A-61-142123 are capable of keeping their opening wide until they are full because of the thin metal ribbon or wire provided along the opening edge or the supporting frame to which the four corners of the bag are fastened. However, these bags are not designed to be re-opened once they are closed by bending the wire or the like closure means. Therefore, they are difficult to re-open for taking out the contents when necessary.

The gusset bags and the article bag disclosed in JP-B-U-51-46372, JP-B-U-53-16507, and JP-A-U-49-12112 also meet various difficulties if used as a self-standing container for packaging a commercial product, such as a powdered detergent. The gusset bag of JP-B-U-51-46372 is designed exclusively for use as a garbage bag that can easily be closed after it is full by means of a thin metal ribbon or wire provided along the opening edge of each side face. Therefore, re-opening the once closed top is very troublesome. If used as a packaging bag and when re-opened to take out the contents, the article bag of JP-B-U-53-16507 has difficulty in unfolding the gusseted side faces and keeping the opening wide, making it difficult for a user to take out the contents. The gusset bag of JP-A-U-49-12112, which is formed of paper, plastics, etc., is designed to be closed without using a paper seal, etc. by bending a metal closure attached along the opening edge of the bag. It is not designed to stand by itself with the side faces unfolded open so as to allow a user to take out the contents easily.

When the above-described general conventional method for attaching a plastically deformable wire-like member to a bag made of a sheet material is applied to a vertical attachment of a wire-like member along each of the four vertical lateral edges connecting the adjacent faces, the operation is troublesome and difficult to carry out. In other words, it is difficult to vertically affix four wire-like members along the respective lateral edges at one time. Therefore, it is necessary to accurately position each wire-like member at each lateral edge while changing the front of the bag each time, which requires much time and effort.

The gusset bag of JP-A-8-244795 has a strip provided across each side face thereof. The length of the strip is equal to the width of the side face. When the bag is flat, that is, when the side gussets are folded flat, the strips are folded in halves to project from the respective side edges. When the side gussets are unfolded to expand the bag, the strips are also unfolded to face the respective side faces of the bag. A plate is inserted through between each folded strip and each folded side face and then turned 90 degrees thereby to unfold the side faces and open the top of the bag widely. According to this design, it is necessary to use two plates for opening the top of the bag, which makes the configuration and the operation complicated. Therefore, it has been demanded to develop a more simply configured gusset bag that can be opened and kept open widely more easily.

There is another problem to be considered about a gusset bag from which a requisite amount of the contents, such as a detergent, is taken out repeatedly. That is, accordingly as the contents are consumed, the vacant space in the bag increases. As a result, the depth from the output opening to the contents increases, which makes it more difficult to take out the contents.

SUMMARY OF THE INVENTION

The present invention relates to a bag formed of one or more sheet materials, such as a pouch or a gusset bag, which is adapted to seal in contents and to a detergent package having a powdered or granular detergent packed in the bag. The bag with contents is adapted to be opened by, for example, cutting off the sealed upper end thereof so that the contents may be taken out repeatedly. With the upper end cut off to make an output opening, the bag with contents is capable of standing by itself while keeping its opening wide so that a user may easily take out a necessary amount of the contents many times and, after every use, capable of being re-closed easily and effectively seal in the contents until next use.

The present invention also relates to a bag such as a gusset bag formed by a method for accurately, rapidly and easily positioning wire-like members and attach them along the lateral edges of a bag stably and efficiently and to a bag such as a gusset bag featuring excellent re-closability by the method, and relates to a method for attaching a wire-like member to a bag such as a gusset bag.

The present invention also relates to a method for easily attaching a plastically deformable wire-like member inside a fused hem joint along a lateral edge of a bag formed of a sheet material.

The present invention also relates to a gusset bag having a simple structure and is yet openable through an easy operation to form an output opening that can be kept wide so that a user may take out the contents easily and smoothly.

The present invention also relates to a gusset bag and a package product having a powdered or granular detergent in the gusset bag, from which the contents can easily be taken out, and which can be easily and securely re-closed to effectively seal in the contents, and which guarantees the ease of taking out the contents even after the amount of the contents decreases by consumption.

The present invention provides a bag formed of a sheet material with a plastically deformable wire-like member attached along a lateral edge thereof. The wire-like member is disposed inside the fused joint of a folded back hem seal formed along the lateral edge.

The vertical wire-like member is preferably disposed inside the hem seal joint with the portion around the wire-like member left non-fused. The non-fused portion is between the wire-like member and the fused portion of the joint. The non-fused portion can be provided around the whole circumference of the wire-like member and is preferably provided around the upper and lower ends of the wire-like member.

In a preferred embodiment, a tubular holder is formed inside the hem seal joint, and the wire-like member is inserted in the holder.

The present invention also provides a gusset bag having a pair of main faces and a pair of inward folding side faces which is adapted to be opened at the upper end thereof in the self-standing state to allow a user to take out the contents. The gusset bag of the present invention has a plastically deformable wire-like member attached along the lateral edge connecting the adjacent faces over a length from the output opening side portion to the body portions of the bag.

In a preferred embodiment, the gusset bag has a tubular holder for inserting a wire-like member therein formed along each lateral edge connecting the lateral faces and a plastically deformable wire-like member inserted into each of the tubular holders over a length from the output opening side portion to the body portion of the gusset bag.

The wire-like members attached are preferably covered with a resin.

In a preferred embodiment, the gusset bag has the wire-like members vertically attached to the side faces along every lateral edge and further has a plastically deformable wire-like member laterally attached to each side face to substantially form the shape of an inverted angular "U" together with the pair of vertically attached wire-like members on each side face.

In a preferred embodiment, the gusset bag has a plastically deformable wire-like member attached to each side face thereof such that the wire-like member is bent symmetrically about the centerline between the two lateral edges of the side face so as to be oblique to the lateral edges.

In a preferred embodiment, the gusset bag has, on at least one of the main faces, a guide line for cutting off the upper part of the bag, the guide line intersecting with the attached wire-like members, and the attached wire-like members are tearable along the guide line. The guide line for cutting will hereinafter be referred to as a cutting guide line.

The gusset bag preferably has a projection for creating a level difference which is provided across the centerline of each of the side faces below the upper end output opening.

The gusset bag preferably has a fin-like rib projecting on the outer side of each side face along the centerline of the side face. The fine-like rib is formed by folding a narrow longitudinal area symmetric about the centerline to make a mountain fold on the outer surface of the side face along the centerline and adhering the facing inner sides of the mountain fold.

In a preferred embodiment, the attached wire-like members extend to the bottom of the body portion.

The gusset bag preferably has a hem seal on the outer side thereof along every lateral edge, and the attached wire-like members are attached to or near the respective hem seals with an adhesive tape or an adhesive or by welding.

The gusset bag preferably has a hem seal on the outer side thereof along every lateral edge, and the attached wire-like members are attached between two facing sides forming the respective hem seals.

The gusset bag is preferably formed of a multilayer composite sheet containing an aluminum foil layer.

The tubular holder is preferably formed on the hem seals by bonding the sheet material making the gusset bag along each lateral edge to a prescribed width with the innermost sealable layer of the sheet material facing to itself.

The projection creating a level difference preferably has the shape of a strip with its length across the centerline of the side face.

The projection creating a level difference is preferably a linear portion provided across the centerline of the side face.

The projection creating a level difference is preferably formed by pressing the side face.

The projection creating a level difference is preferably formed by sticking a piece of a sheet material to the side face.

In a preferred embodiment, the number of the projections creating a level difference is two or more per face side, and the projections are provided at intervals in the height direction of the side face.

The fin-like rib is preferably provided from the upper edge of the upper end output opening downward.

The fin-like rib is preferably provided from the upper edge of the upper end output opening to the bottom of the bag.

The fine-like rib is preferably formed by adhering the facing inner sides of the mountain fold by heat sealing from the outer side of the gusset bag.

The plastically deformable wire-like member obliquely provided on the side face is oblique from the centerline toward the upper end of both the lateral edges.

The plastically deformable wire-like member obliquely provided on the side face has the shape of "V".

The plastically deformable wire-like member obliquely provided on the side face is oblique from the lower end of the centerline toward the upper end of both the lateral edges.

In a preferred embodiment, the gusset bag further has a plastically deformable secondary wire-like member symmetrically bent about the centerline in each of the side faces and oblique to the lower end of both the lateral edges.

The number of the cutting guide lines is two or more, and the guide lines are provided at intervals in the height direction of the gusset bag.

The cutting guide line is formed of tear tape which is adapted to be pulled to laterally cut the gusset bag.

The present invention also provides a package product having a powdered or granular detergent packed in the above-described gusset bag.

The present invention also provides a gusset bag formed by a method of vertically attaching plastically deformable wire-like members to a gusset bag having a pair of main faces and a pair of inward folding side faces and an opening at the top thereof. According to the method, a vertical tubular holder for holding a wire-like member is formed along each lateral edge of a gusset bag. The upper end of the tubular holder is open to the inside of the gusset bag and below the top edge around the opening to leave an open space therebetween. Wire-like members are positioned such that all their lower ends are inside the opening, below the top edge around the opening, and right above the open end of the respective tubular holders while pressing the lower part of the wire-like members toward the respective lateral edges from inside. Thereafter, the thus positioned four wire-like members are moved down and inserted into the respective tubular holders. Finally, the upper open end of the tubular holders is sealed.

The present invention also provides a method of vertically attaching a plastically deformable wire-like member inside a fused joint along a lateral edge of a bag formed of a sheet material. In the method, the inside corner of the lateral edge is held open, and a non-magnetic tube having a magnetic wire-like member inserted therein is disposed along the inside corner. Only the tube is drawn from the inside corner while holding the wire-like member in place by means of a magnet set outside of the lateral edge. Thereafter the lateral edge is heat sealed from the outside thereby to fix the wire-like member in the joint.

The present invention also provides another method of vertically attaching a plastically deformable wire-like member to a bag. According to this method, an open-topped tubular holder is formed in the joint, and the wire-like member is inserted in the holder. Thereafter, the open top of the tubular holder is heat sealed. The wire-like member is thus disposed inside the joint formed by fusion along the lateral edge.

The term "output opening side portion" as used herein denotes a portion at and above a fold along which the gusset bag is folded back for re-closure. The position of the fold is arbitrary as long as it is below the opening and above the body portion of the gusset bag. Accordingly, the term "body portion" as used herein means a portion below the above-identified fold. The "body portion" is the main body of the gusset bag where the contents can be held. The position of the fold along which the upper part of the gusset bag is folded back for re-closure can be lowered with a decrease of the contents. Seeing that the position of the fold is not specified previously but is arbitrarily chosen within a certain range, a gusset bag is, for convenience sake, divided into two portions along the fold along which the bag is actually folded back for re-closure. The upper portion inclusive of the fold itself is designated "the output opening side portion", and the lower portion "the body portion". Accordingly, the expression "over a length from the outlet opening side portion to the body portion of the bag" used to explain the position of wire-like members means that the wire-like members are attached over a vertically extending area where the bag is expected to be folded back for re-closure.

The plastically deformable wire-like members and lateral wire-like members are wire-like members having such plastic deformability that they are easily bent by the force of fingers and capable of retaining the bent shape and having such shape retentive rigidity that, when the unloading opening portion is folded back to re-close the gusset bag, they resist the restoring force of the sheet material of the output opening side portion and stably retains the folded state of the outlet opening side portion. Such wire-like members include wire, plates, strips, mesh, and ribbons made of metal, shape-memory alloys, shape-memory resins, etc. The term "wire-like" as used herein is intended to include not only the shape of thin wire but the shape of strips with some width. The term "wire-like member" as used herein is intended to include not only a continuous member but pieces of a wire-like substance that are disposed continuously.

The wire-like member has a deformable plasticity. A rheological property of solid or semisolid materials expressed as the degree to which they will flow or deform under applied stress and retain the shape so induced, either permanently or for a definite time interval. Plasticity may be considered the reverse of elasticity. Application of heat and/or special additives is usually required for optimum results.

When using a metal-made wire-like member, such as metallic wire, as a plastically deformable wire-like member, it is preferred to cover the wire with a resin. By so doing, the wire-like member substantially becomes thicker to have improved flexural strength and will have an increased inner bending radius when bent plastically. It follows that the wire-like member exhibits effectively improved durability against repeated flexing and are thereby prevented from being broken during use. Even if breakage occurs as a result of repeated flexing, the covering resin keeps the cut end covered to provide safety.

The metallic wire that can be used as a plastically deformable wire-like member includes high carbon steel wire, piano wire, ordinary low carbon steel wire, nail wire, annealed wire, and wire for concrete. From the standpoint of flexural properties and ease of use, annealed steel wire is preferred. These wires may be plated with zinc, aluminum, etc. for corrosion prevention or reinforcement.

Where a plastically deformable wire-like member is attached in a bent form symmetric about the centerline of a side face and oblique to both the lateral edges of that side face, the left and the right parts of the wire-like member that are oblique to the lateral edges may be either straight or curved. The wire-like member in a bent form does not always need to be a continuous member but may be composed of at least one pair of the wire-like members separated apart at, for example, the centerline of the side face. In this case, the two adjacent wire-like members may be arranged either in contact or not in contact with each other.

The projection for creating a level difference is a part providing and retaining a level difference as a projection projecting either outward or inward on at least a cross-section of the sheet material taken along the centerline of a side face when the side face is unfolded flat. Such an outward or inward projection or level difference is formed by providing the sheet material by creasing or pressing or by adhering a separate piece of a sheet material to the sheet material of the side face. When the side face is unfolded flat, such a projection is effective to keep the unfolded flat state. While the projection preferably has the form of a strip or the form of a line with some length across the centerline of the gusset, a projection having other shapes, such as a circle and polygons including a rectangle may be provided at a position overlapping with the centerline. It should be noted that the configuration of the projection is designed so as not to hinder inward folding of the gusseted side face into a flat shape.

The fin-like rib is a fin-like strip-shaped projection sticking out of an unfolded side face vertically along the centerline of the side face. The fin-like rib is preferably formed by folding a narrow longitudinal area symmetric about the center line to make a mountain fold projecting on the outer surface of the side face along the centerline and adhering the facing inner sides of the folded narrow area. The shape of the fin-like rib includes an elongated rectangle, an elongated triangle, and an elongated trapezoid. The fin-like rib is provided on only the upper portion of the side face, which is effective in keeping the upper end output opening wide, or over the whole length of the side face, i.e., from the top edge to the bottom.

According to the embodiment of the gusset bag having a projection for creating a level difference or a vertical fin-like rib on the side faces, the upper end output opening can be kept wide open, which makes it easier for a user to take out the contents smoothly.

The cutting guide line is a line or a narrow width linear part along which a user can easily cut the gusset bag laterally. Such a cutting guide line includes a line for guiding a user in cutting with a cutting tool, such as a pair of scissors, and a linear part having per se a tearing function, such as a part containing tear tape. Where the guide line is a line indicating the position to be cut along with a cutting tool, a guide line on at least one of the main faces will do. Where the guide line is a linear part having a tearing function per se, such as the one having a tear tape, it is preferably provided over the whole circumference of the gusset bag, i.e., around the pair of main faces and the pair of side faces.

In the preferred embodiment wherein the gusset bag has the above-described cutting guide line, the wire-like members that are tearable along the cutting guide line include those made of a cuttable material that can be cut off with a cutting tool, such as scissors, those having a part made of such a cuttable material at the position intersecting with the cutting guide line, and those having previously been cut at the position intersecting with the cutting guide line (i.e., cut pieces are arranged with an appropriate interval as if to form a broken line) so as to be separated apart when the bag is cut along the guide line.

According to the embodiment of the gusset bag having a cutting guide line, a user can easily take out the contents from the bag while leaving the bag self-standing and easily and securely re-close the output opening side portion to store the contents effectively. Even after the contents have decreased, ease in taking out the contents is guaranteed.

Thus, the present invention provides a bag which is adapted to be filled with contents and sealed at the top to provide a packaged product that can be cut to remove the top seal to make an output opening from which the contents are taken out repeatedly when needed. The present invention also provides a package product having a powdered or granular detergent packed in the bag. According to these aspects of the present invention, the bag can re-close its output opening side portion easily and securely to effectively store the contents and be re-opened for enabling taking out the contents repeatedly.

According to another aspect of the invention providing a bag such as a gusset bag having tubular holders for vertical wire-like members along the lateral edges and a method for attaching the vertical wire-like members to the bag, it is possible to position a wire-like member accurately, rapidly, and easily and to attach the wire-like member along the lateral edges stably and efficiently, thereby providing a bag having excellent re-closability.

According to the method of attaching a wire-like member to a bag formed of a sheet material, a plastically deformable wire-like member can easily be disposed inside the fused joint along a lateral edge of the bag.

The preferred embodiments of the present invention will now be described with reference to the accompanying drawings.

Figure 2A:
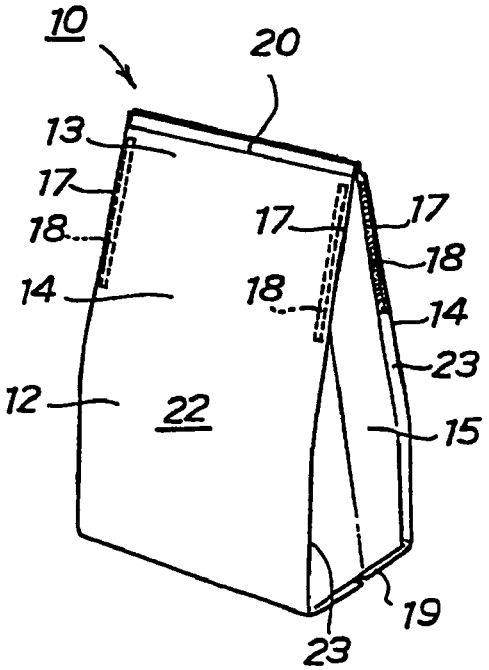
FIG. 2(*a*) is a perspective of a gusset bag with contents (i.e. a package) according to the first preferred embodiment.
Figure 2B:
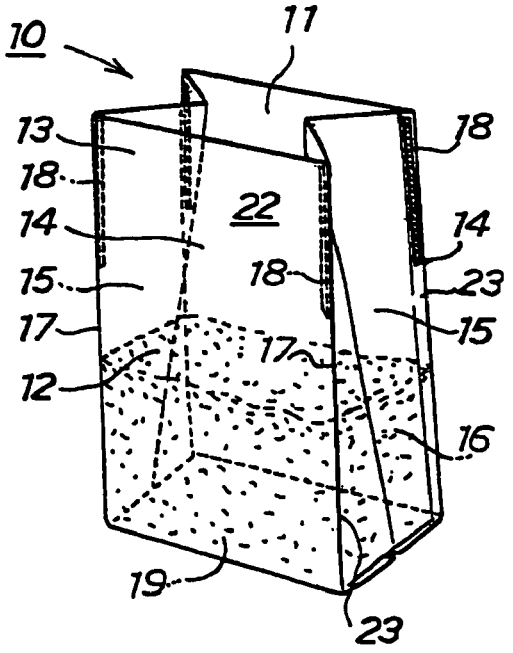

In FIGS. 1, 2(*a*) and 2(*b*) is shown a gusset bag 10 formed of a sheet material 22 according to the first preferred embodiment. The gusset bag 10 is used as a container for holding, for example, a powered detergent as contents. As shown in FIGS. 2(*a*) and 2(*b*), the gusset bag 10 with the contents is sealed at its upper end opening 11 to be supplied as a commercial product package. It has a cutoff line 20 along which a user cuts off the top seal to form the upper end output opening 11 from which to take out the contents 16. Each time after a user takes out a necessary amount of the contents 16 such as detergent from the gusset bag 10, the output opening side portion 13 of the gusset bag 10 can be closed smoothly and stably (see FIG. 6) to store away the remaining contents 16 (e.g., detergent) effectively. The gusset bag 10 according to the first embodiment constitutes a package with contents, such as a hygroscopic substance, e.g., a granular detergent. The gusset bag 10 of the first embodiment is suited as a packaging container for detergents, foods, and the like that is opened and closed repeatedly where water exists.

The gusset bag 10 as a container bag has a pair of main faces (a front face and a rear face) 14 and a pair of gusseted side faces 15 that are folding inward to make a V-shape. The gusset bag 10 as a container bag is designed to self-stand, and is adapted to be cut off at the top end to make an upper end output opening 11 in the standing state and keep the opening wide enough in the standing state so that a user may weigh out the contents 16 by one hand with ease. For that purpose, the gusset bag 10 has a plastically deformable vertical wire-like member 18 attached along each of the lateral edges 17, i.e., the intersections of the main faces 14 and the side faces 15, over a length from the output opening side portion 13 to the body portion 12 of the bag 10.

The gusset bag 10 is formed by fabricating one or more sheet materials (or film materials) 22 having been cut to size as designed through various known methods including folding and bonding. The sheet material(s) 22 is/are shaped to make a rectangular bottom 19 and a pair of main faces 14 and a pair of side faces 15 upstanding from the respective sides of the bottom 19 thereby forming a gusset bag composed of a body portion 12 defined by the bottom 19 and faces 14 and 15, in which to hold a detergent, and an output opening side portion 13 which is integral with the body portion 12 and above the body portion 12 and is to be folded back when the gusset bag 10 is re-closed. After a predetermined amount of contents 16 is poured into the body portion 12 from the upper end opening 11 (see FIG. 2(*b*)), the opposite side faces are folded inward into a V-shape, and the opening is closed by, for example, seal bonding (top seal) thereby sealing in the contents 16 as shown in FIG. 2(*a*). The output opening side portion 13 where the contents 16 is not present is folded back a desired number of times, for example, double folded to provide a final product (see FIG. 1).

Figure 3A:
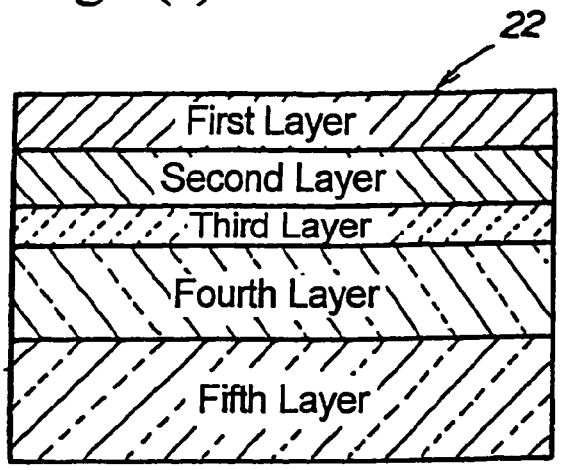
FIGS. 3(*a*) and 3(*b*) are cross-sections showing examples of a layer structure of a sheet material making a gusset bag of another embodiment of the invention.
Figure 3B:
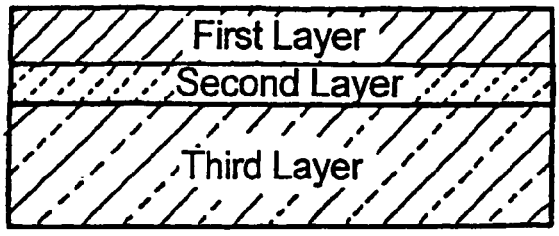

The sheet material 22 used to make the gusset bag 10 of the first embodiment is a composite sheet containing an aluminum foil. The composite sheet preferably has a five-layered structure shown in FIG. 3, which is composed of a first layer of polyester as an outermost layer, a second layer of polyethylene, a third layer of aluminum foil, a fourth layer of polyethylene, and a fifth layer of a sealable material as an innermost layer. The thickness of the aluminum foil layer is preferably 5 to 50 μm, still more preferably 5 to 20 μm. Use of such a multilayered composite sheet containing an aluminum foil layer as a sheet material 22 not only facilitates folding for re-closure but keeps a good appearance of the package because of its resistance to wrinkling.

The pair of main faces 14 and the pair of side faces 15 are joined together along lateral edges 17 via hem seals 23, thereby forming a space defined by the body portion 12 and the output opening side portion 13 and having a rectangular cross-section. The hem seal 23, i.e., a joint at each lateral edge 17, is formed by, for example, folding back the lateral edge to make a mountain fold with a width of about 2 to 30 mm and bonding the facing inner sides, which are innermost sealable layers, together. The four upper edges of the output opening side portion 13 in its opened state make a rectangular upper end output opening 11 having substantially the same size as the bottom 19. The gusset bag 10 is capable of retaining its standing shape and keeping its opening wide enough by virtue of the hem seals 23 along the four lateral edges formed by joining the main faces 14 and the side faces 15.

The gusset bag 10 has plastically deformable vertical wire-like member 18 attached along each of the lateral edges 17. The plastically deformable vertical wire-like members 18 can be of metal wire having a thickness, e.g., of 0.1 to 5.0 mm, preferably 0.3 to 1.0 mm. The wire-like members 18 are attached to the outer side of the side faces 15 near or on the respective hem seals 23 and in parallel with the respective hem seals 23 over a length from the output opening side portion 13 to the body portion 12 by means of, for example, an adhesive tape.

Figure 4A:
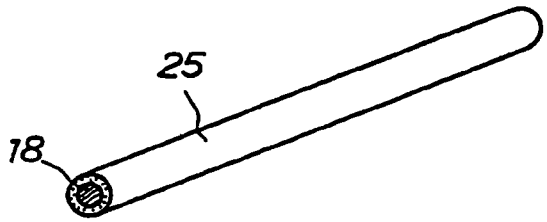
FIG. 4(*a*) and FIG. 4(*b*) each show an example of a resin-covered plastically deformable wire-like member.
Figure 4B:
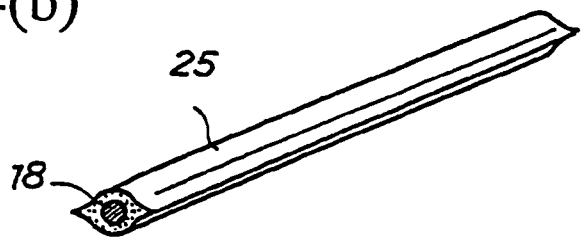
Figure 5A:
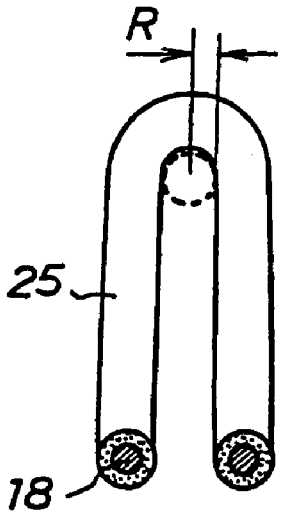
FIG. 5(*a*) and FIG. 5(*b*) each show an inner bending radius R of a bent plastically deformable wire-like member.
Figure 5B:
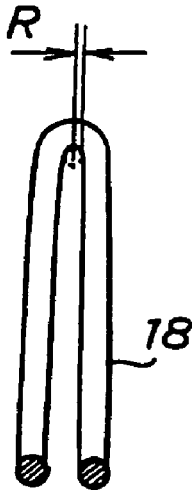

In the first embodiment, the vertical wire-like members 18 made of metal wire are preferably covered with a resin 25 as shown in FIG. 4(*a*). The resin 25 includes polyolefin resins, vinyl chloride resins, polyester resins, and polyamide resins. The thickness of the covering resin 25 is preferably 0.05 to 5.0 mm. From the standpoint of appearance of the package, the thickness is still preferably 0.05 to 3.0 mm. The vertical wire-like member 18 covered with the resin 25 gains in diameter and thereby exhibits improved flexural strength. Additionally, as can be seen by comparing FIGS. 5(*a*) and 5(*b*), an inner bending radius R of a resin-covered vertical wire-like member 18 when bent 180° (FIG. 5(*a*)) is larger than that of an uncovered vertical wire-like member 18 (FIG. 5(*b*)). For instance, when the inner 180° bending radius R of an uncovered wire-like member 18 is less than 1 mm, covering with a resin increases the R to 1.5 mm or more, preferably 2.5 mm or more. As a result, the vertical wire-like members 18 enjoy improved durability against repeated flexing and are prevented from breaking during use of the gusset bag 10. Even if the vertical wire-like member 18 breaks as a result of repeated flexing, the cut end is safe, being covered with the resin 25.

Covering the vertical wire-like member 18 with the resin 25 further brings about improved processability of the member 18 and improved workability in attaching the member 18 to the gusset bag 10. The vertical wire-like member 18 may be covered with the resin 25 in such a manner that the resin-covered wire-like member 18 has a flattened shape as shown in FIG. 4(*b*). In this case, the vertical wire-like member 18 will have further improved handling properties and improved adhesion to the side faces 15 when bonded by, for example, heat sealing owing to the increased adhesion area to the bag. Furthermore, setting properties to the tubular holder for holding a wire-like member are improved.

As previously stated, the gusset bag 10 is used to seal in contents 16 such as a powdered detergent to provide a package to be supplied into the market (for example, a detergent package). A user cuts off the seal on the top of the packaged gusset bag 10 to form an unloading opening 11 and weighs out a necessary amount of the detergent when necessary. While self-standing, the gusset bag 10 keeps its upper end output opening 11 wide enough for a user to take out a portion of the contents 16 efficiently. After every use, the output opening side portion 13 can easily be folded back to surely seal in the contents 16 until next use.

The gusset bag 10 is provided with the plastically deformable vertical wire-like member 18 along each of the four lateral edges 17 from the output opening side portion 13 to the body portion 12. Therefore, when the top of the package 10 is opened to form the output opening 11 that is a rectangle, the vertical wire-like members 18 along the four lateral edges serve as pillars to keep the rectangular opening 11 wide. A user can easily and efficiently take out a required amount of the contents, contents 16, from the wide upper end output opening 11 of the package placed on its bottom 19.

Figure 6:
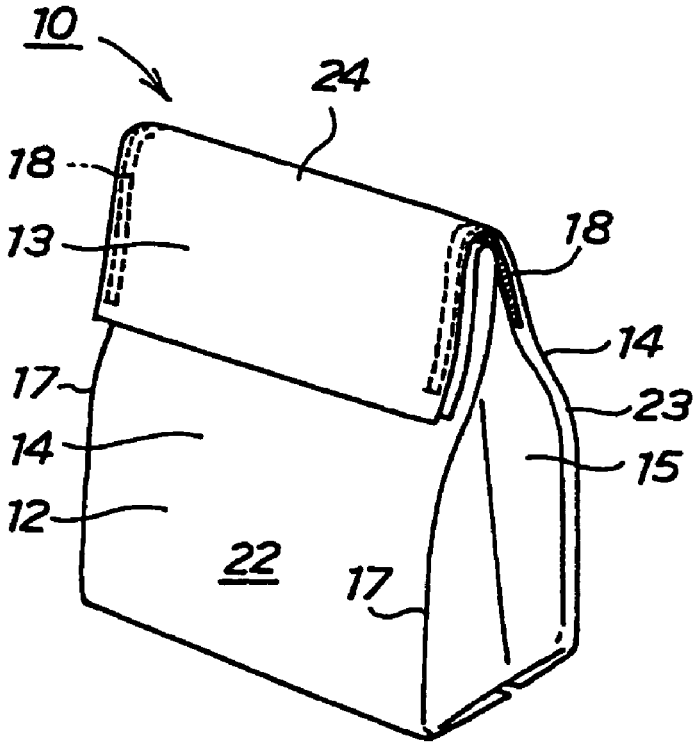
FIG. 6 is a perspective of a gusset bag with its unloading opening portion folded back to be re-closed.

The vertical wire-like members 18 attached along the four lateral edges 17 have plastic deformability such that they can easily be bent by the force of fingers and retain the bent. They also have shape-retentive rigidity such that they are capable of retaining the plastically deformed (bent) state against the restoring force of the sheet material 22 in the bent portion, i.e., the output opening side portion 13. Therefore, the upper end output opening 11 can be closed simply by bringing the upper edges of the opposite main faces 14 together while folding the side faces 15 inward and folding the sheet material 22 of the output opening side portion 13 downward along a fold 24 as shown in FIG. 6. In this way, the opened gusset bag 10 can be easily and surely re-closed.

While the opened gusset bag 10 can be re-closed by folding the output opening side portion 13 once to make the fold 24 as shown in FIG. 6, it is also possible to fold the output opening side portion 13 twice as depicted in FIG. 1 to seal in the contents more securely. If desired, a guide line for folding the output opening side portion 13 may be provided on the main face 14. As the contents 16 are consumed, the position of the fold 24 may be lowered accordingly. After some quantity of the contents 16 are used, the upper part of the gusset bag 10 may be cut off at a suitable height so as to make it easier to take out the residual contents 16.

Next time the contents 16 is used, the bent vertical wire-like members 18 are unbent by plastic deformation to re-open the gusset bag 10. Thus, the gusset bag 10 can be re-opened and re-closed by the aid of the vertical wire-like members 18 every time the contents 16 is used.

Figure 7:
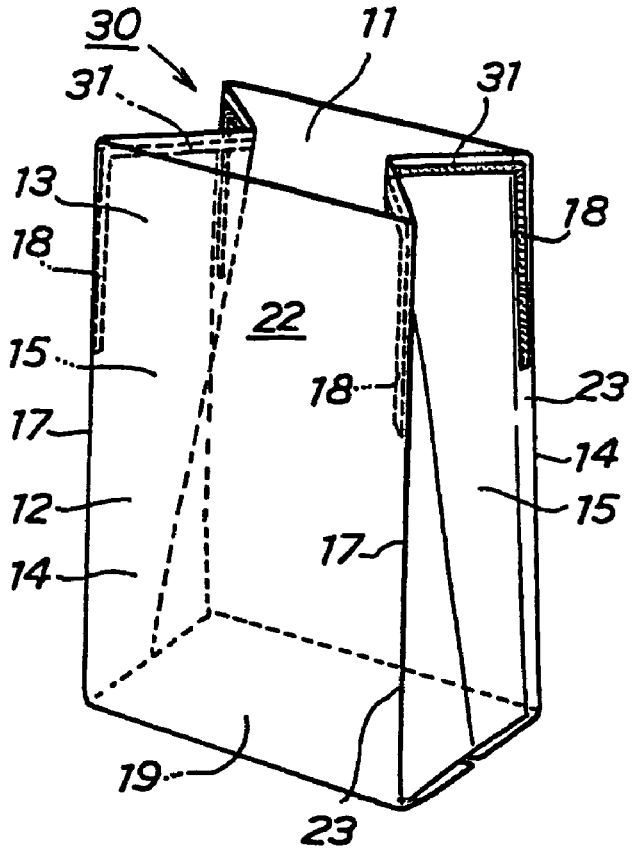
FIG. 7 is a perspective of a gusset bag according to a second preferred embodiment of the invention with its upper end open.

FIG. 7 shows a gusset bag 30 according to the second preferred embodiment of the present invention. The gusset bag 30 further has a plastically deformable lateral wire-like member 31 laterally attached to each side face 15 to substantially form the shape of an inverted angular "U" together with the pair of the vertical wire-like members 18 on that side face 15.

According to the second embodiment, the following effect is obtained in addition to the effects by the first embodiment. When the upper end outlet opening 11 is closed, the lateral wire-like members 31, which are provided across the respective gusseted side faces 15, are bent into halves. When the outlet opening 11 is opened, the V-folded side faces 15 are unfolded, and the lateral wire-like members 31 are unbent straight to help the output opening side portion 13 to retain the rectangular upper end output opening 11 easily. Thus, the gusset bag 30 is easier and more effective for a user to take out the contents 16 such as a detergent.

Figure 8:
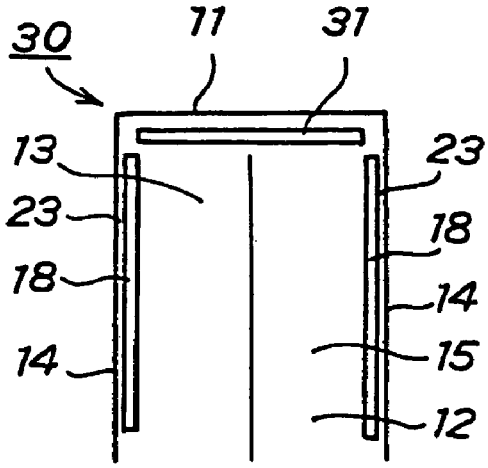
FIG. 8 is a side view of a gusset bag according to the second preferred embodiment, in which vertical wire-like members and a lateral wire-like member per side face are arranged differently from FIG. 7.

The lateral wire-like member 31 does not always need to be arranged to form the shape of a perfect inverted angular "U" together with the pair of the vertical wire-like members 18 on the side face 15. In other words, the shape of an inverted angular "U" may be formed of three separate straight lines, i.e., the pair of the vertical wire-like members 18 and the lateral wire-like member 31 spaced apart from the upper ends of the vertical wire-like members 18. For example, the lateral wire-like member 31 may be arranged between or above the upper ends of the vertical wire-like members 18 with a small distance between each end of the former and the upper ends of the latter as illustrated in FIG. 8. The lateral wire-like members 31 can be covered with the resin 25 similar to the vertical wire-like members 18.

Figure 9:
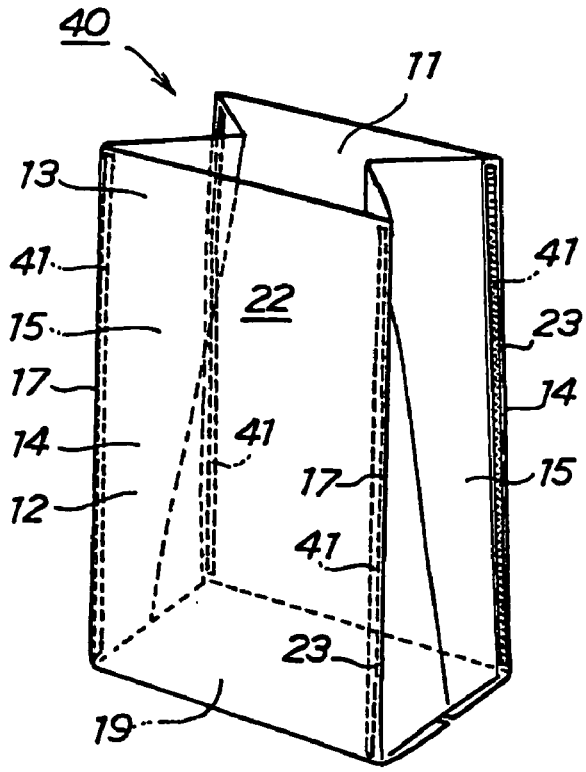
FIG. 9 is a perspective of a gusset bag according a third preferred embodiment of the invention with its unloading opening open.

FIG. 9 shows a gusset bag 40 according to the third preferred embodiment of the present invention. The gusset bag 40 is different from the gusset bag 10 of the first embodiment in that the vertical wire-like members 18 attached to the gusseted side faces 15 along the hem seals 23 extend to reach the bottom of the body portion 12.

According to the third embodiment, the following effect is exerted in addition to the effects obtained by the gusset bag 10 of the first embodiment. Since the vertical wire-like members 41 extend to the bottom of the body portion 12, the wire-like members 41 are supported by the side pressure of the contents 16 in the body portion 12 to keep themselves upstanding and therefore exert their function as pillars more effectively. In addition, the fold 24 can be lowered with the decrease of the contents 16, and the output opening side portion 13 can be folded back for re-closure at any position in the height of the gusset bag 40.

Figure 10A:
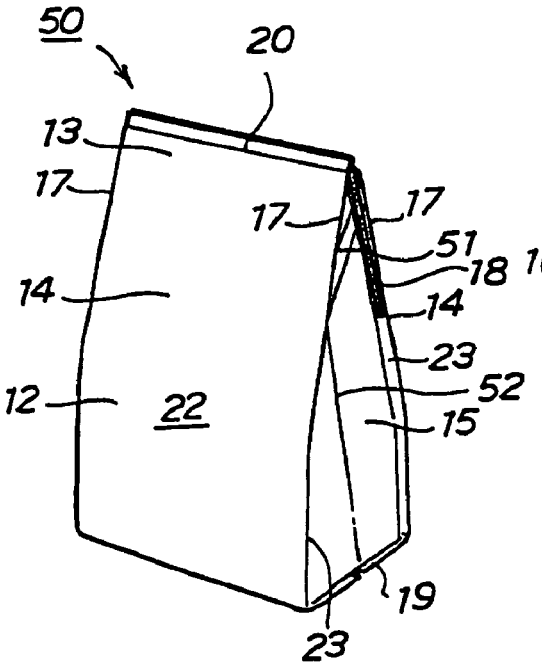
FIG. 10(*a*) is a perspective of a gusset bag with contents (package) according to a fourth preferred embodiment of the invention.
Figure 10B:
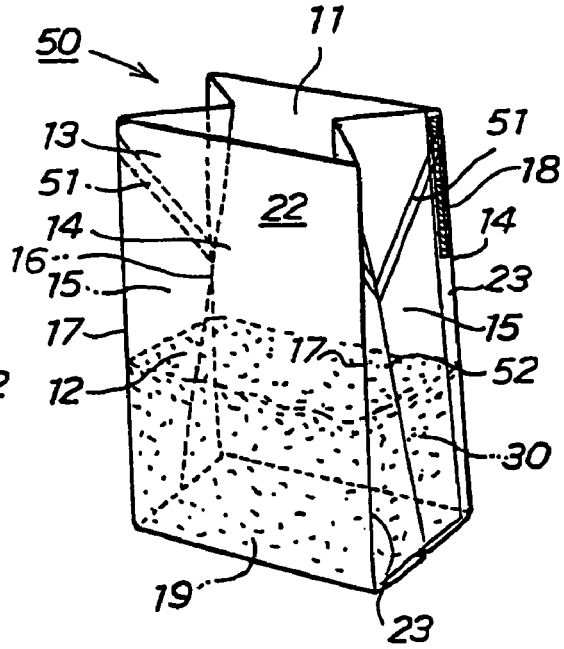
Figure 11:
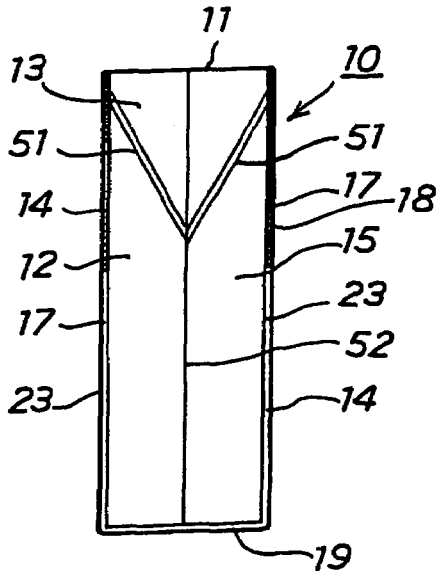
FIG. 11 is a side view of the gusset bag of FIG. 10(*b*), showing the arrangement of the wire-like members.

FIGS. 10(*a*), 10(*b*), and 11 show a gusset bag 50 according to the fourth preferred embodiment of the present invention. The gusset bag 50 has a plastically deformable second wire-like member 51 attached to each side face 15 in addition to the vertical wire-like members 18 of the first embodiment. The second wire-like member 51 on each side face 15 is bent symmetrically about the centerline 52 between the two lateral edges 17 of that side face 15 (the line along which the side face 15 is folded inward) so as to be oblique to the lateral edges 17.

In the fourth embodiment, the bent plastically deformable second wire-like member 51 extends straight from the centerline 52 obliquely upward toward the upper end part of the respective lateral edges to form a V-shape as a whole on each side face 15.

The second wire-like members 51 are made of, for example, metal wire having a thickness of 0.1 to 5.0 mm, preferably 0.3 to 1.0 mm. The second wire-like members 51 are each attached to the outer side of the side face 15 by means of adhesive tape, etc. The second wire-like members 51 are each disposed such that the horizontal axis length is from the centerline 52 to the hem seal 23 on each side and that the vertical axis length is from the output opening side portion 13 to the body portion 12.

The second wire-like members 51 are each preferably covered with a resin similarly to the vertical wire-like members 18.

The gusset bag 50 produces the following effects in addition to the effects of the first embodiment. The plastically deformable second wire-like member 51 is bent at the centerline 52 so that it extends from the centerline 52 toward the lateral edges 17 on both sides of the centerline 52 obliquely. When the upper end output opening 11 is opened into a rectangle, the second wire-like member 51 that has been folded inward at the centerline 52 is pressed outward to be unfolded flat and thereby positioned along the short side of a rectangular cross-section of the opened gusset bag 50. By this configuration, the rectangularly widened output opening 11 can effectively be retained by the shape retentive rigidity of the second wire-like member 51. This facilitates taking out the contents 16 efficiently from the gusset bag 50 standing on its bottom 19.

The length of the second wire-like member 51 in the height direction can be from the output opening side portion 13 to the body portion 12. The second wire-like members 51 are easily deformable by the force of fingers. They also preferably have shape-retentive rigidity such that they are capable of retaining the folded state of the output opening side portion 13 against the restoring force of the sheet material 22. Therefore, the output opening side portion 13 can be re-closed simply by bringing the upper edges of the opposite main faces 14 together while folding the side faces 15 inward together with the respective second wire-like members 51 and folding the sheet material 22 of the output opening side portion 13 downward along a fold 24 together with the second wire-like members 51. In this way, the second wire-like members 51 achieve surer re-closure of the gusset bag 40 with more ease in cooperation with the vertical wire-like members 18.

Figures 12A, 12B, 12C, 12D:
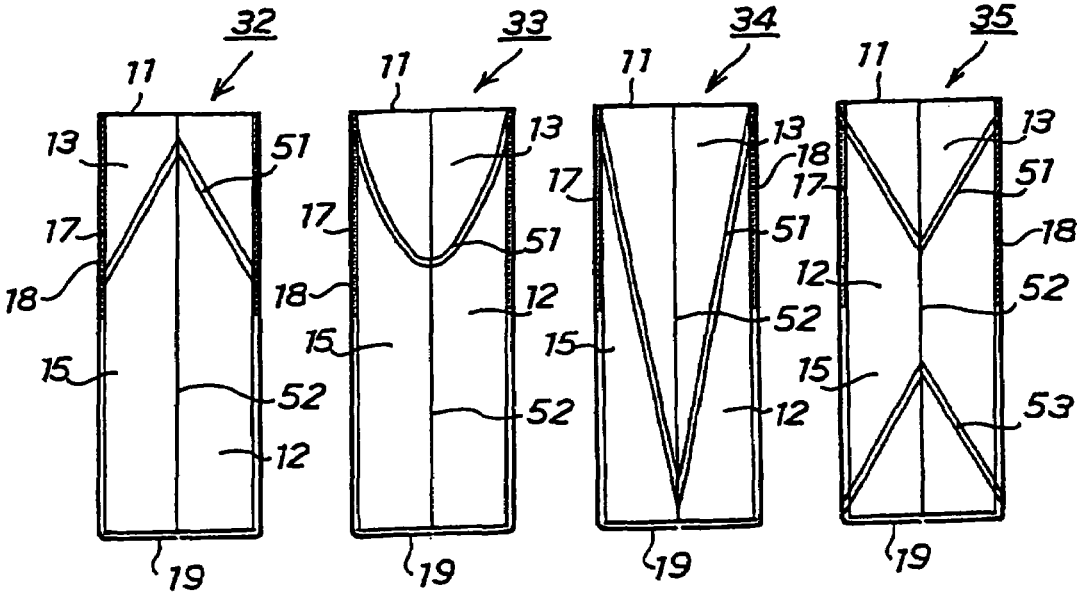
FIG. 12(*a*) through FIG. 12(*d*) are each a side view of a gusset bag according to another embodiment, showing different ways of arranging wire-like members.

The arrangement of the individual second wire-like members 51 that are bent at the centerline 52 is not limited to the above-described one. For example, they can be disposed as illustrated in FIGS. 12(*a*) through 12(*d*). The second wire-like member 51 of FIG. 12(*a*) extends from the centerline 52 obliquely downward to form the shape of an inverted "V". The second wire-like member 51 of FIG. 12(*b*) depicts a parabola, curving upward from the centerline 52. The second wire-like member 51 of FIG. 12(*c*) extends from the lower end part of the centerline 52 toward the upper end part of the respective lateral edges 17 to form an elongated "V" shape. In FIG. 12(*d*), the V-shaped second wire-like member 51 is attached to extend obliquely upward from the centerline 52, and a secondary V-shaped plastically deformable wire-like member 53 is attached to extend from the centerline 52 obliquely downward toward the lower end part of the respective lateral edges 17 to make an inverted "V" shape.

The gusset bags having the second wire-like members 51 arranged as shown in FIGS. 12(*a*) through 12(*d*) produce substantially the same effects as obtained by the gusset bag 50 of the fourth embodiment. The gusset bag of FIG. 12(*c*) yields an addition effect that the position of the fold 24 (see FIG. 6) can be lowered within a broader range of height with a decrease of the contents 16 in folding back the output opening side portion 13 for re-closure. The gusset bag of FIG. 12(*d*) is effective to retain the space near the bottom 19 more firmly to help a user take out the contents 16 more efficiently.

Figure 13:
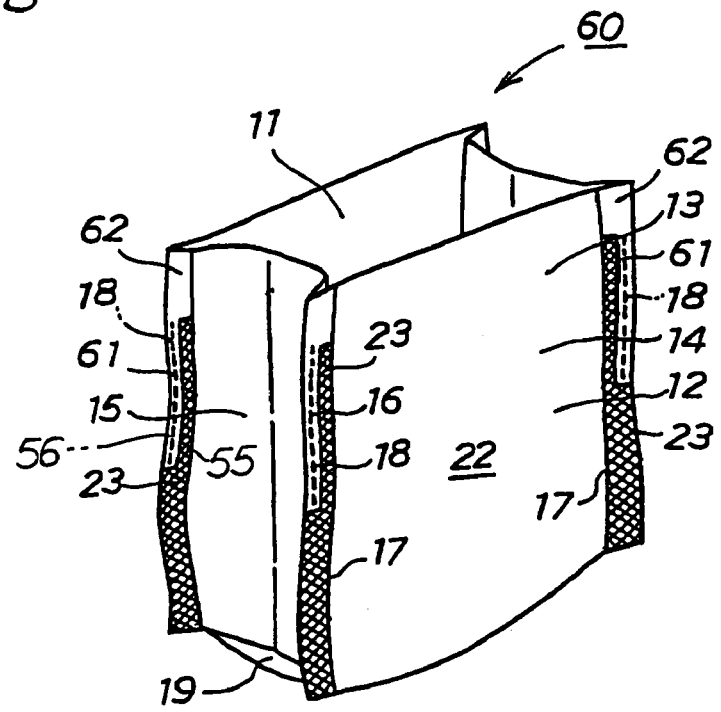
FIG. 13 is a perspective of a gusset bag according a fifth preferred embodiment of the invention.

FIG. 13 shows a gusset bag 60 according to the fifth preferred embodiment of the present invention. The gusset bag 60 has a vertical tubular holder 61 for holding a wire-like member formed along each lateral edge 17 and four plastically deformable vertical wire-like members 18 inserted into the respective tubular holders 61 over a length from the output opening side portion 13 to the body portion 12. The gusset bag of the fifth embodiment may have only two tubular holders with the respective wire-like members provided along two out of the four lateral edges. Nevertheless, the gusset bag preferably has the tubular holder with the wire-like member provided along each of the four lateral edges 17.

The gusset bag 60 has a hem seal 23 along each of four lateral edges 17. The hem seal 23 is formed by, for example, folding back the lateral edge to make a mountain fold with a width preferably of about 2 to 30 mm, still preferably of about 8 to 15 mm, and bonding the facing inner sides, which are innermost sealable layers, together. The tubular holder 61 for inserting a vertical wire-like member is formed in each of the hem seals 23.

Figure 14:
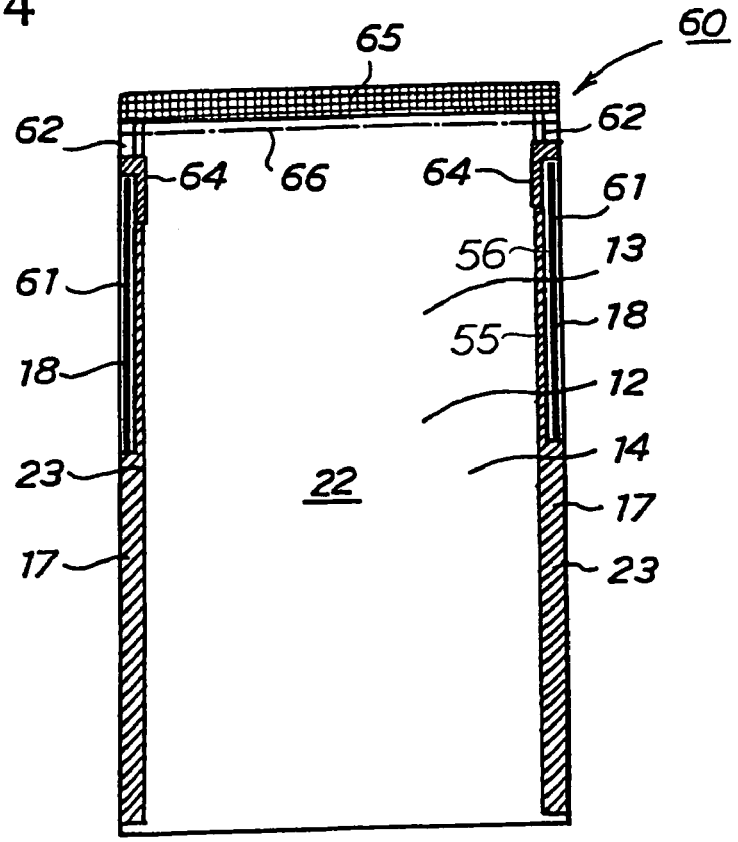

The hem seal 23 is formed by joining the folded back sheet material 22 along each lateral edge 17 to a prescribed width from the lateral edge 17 with the innermost sealable layer facing to itself, and heat sealing the resulting mountain fold between seal bars from the outside. As shown in FIGS. 13 and 14, a vertically extending fused portion 55 is thus formed in agreement with the heating area of the seal bar. In this heat sealing, the fused portion 55 is configured such that the portion in the upper half and outer lateral half of the hem is left non-fused. As a result, the non-fused portion makes a tubular holder 61 along the outermost edge of the hem. Where necessary, the outer edge of the tubular holder 61, i.e., the outermost edge of the hem may be heat sealed to form a narrow, vertically extending fused area as a part of the fused portion 55.

According to the fifth embodiment, the vertical wire-like member 18 is loosely inserted in the vertical tubular holder 61. In other words, the joint of the hem seal 23 has a non-fused portion 56 between the inserted vertical wire-like member 18 and the fused portion 55.

The upper end of the heat-sealed hem seals 23 is about 10 to 50 mm below the top edge around the upper end opening 11 of the gusset bag 60. Therefore, there is preferably an open space 62 as a wire-like member-absent portion left between the top edge around the opening 11 and the upper open end of the tubular holder 61 at each corner of the gusset bag 60. According to the fifth embodiment, the hem seals 23 formed along the lateral edges 17 effectively ensure the shape retention of the gusset bag 60 as well as the size retention of the upper end opening 11.

After a predetermined amount of a detergent is charged into the gusset bag 60 having the vertical wire-like members 18 through the upper end opening 11, the upper end opening 11 is closed and joined by forming a top seal 65 along the opening edge to provide a detergent package containing the contents 16. A point seal 64 is applied to cover the upper end of every hem seal 23 (and the vertical wire-like member 18 and the tubular holder 61). The top seal 65 across the gusset bag 60 is provided above the enclosing seals 64, and a guide line 66 for cutting off the top seal 65 is provided across the gap between the top seal 65 and the point seals 64. That is, the cutting guide line 66 does not intersect with the heat sealed hems 23.

The fifth embodiment provides the following effects in addition to the effects of the first embodiment. Insertion of the four vertical wire-like members 18 into the respective tubular holders 61 can be carried out by simple operation including the steps of positioning the vertical wire-like members 18 right above the upper open end of the respective tubular holders 61 which is open, moving the wire-like members 18 vertically downward into the respective bags 61, and sealing the upper end of the tubular holders 61. Therefore, attachment of the four vertical wire-like members 18 can be performed efficiently by simultaneously positioning, followed by simultaneously moving the four vertical wire-like members downward.

The bag structure according to the fifth embodiment makes it feasible to efficiently and stably attach a plurality of plastically deformable vertical wire-line members 18 along the respective lateral edges 17 by simultaneous positioning and insertion, to provide a gusset bag 60 having excellent reclosability.

The four vertical wire-like members 18 can be surely, rapidly, and easily inserted into the respective tubular holders 61 one by one by hand by utilizing the open space 62 along the lateral edges 17. The wire-like members 18 can be attached at least after the body portion 12 of the gusset bag 60 is formed. The four vertical wire-like members 18 can also be positioned and inserted over a length from the output opening side portion 13 to the body portion 12 all at once by, for example, the following method of attachment.

Figure 15:
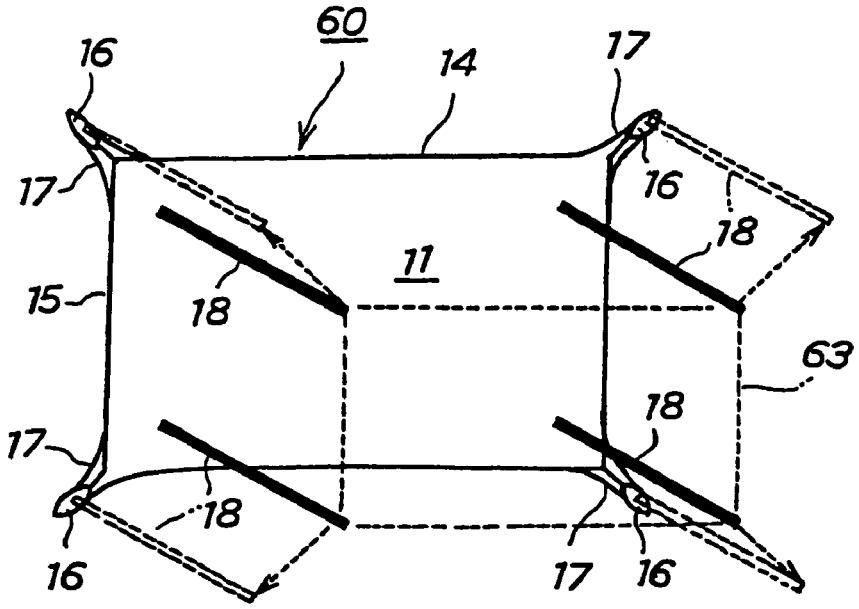
FIG. 15 illustrates the way of inserting vertical wire-like members into the respective tubular holders in the production of the gusset bag of the fifth embodiment.

As shown in FIG. 15, the gusset bag 60 is held upright with its upper end opening 11 up. Four vertical wire-like members 18 are vertically held by a supporting unit and positioned at corners of an imaginary rectangle 63 smaller than the rectangular opening 11 on a plane above the opening 11. Then, the four wire-like members 18 are simultaneously moved down until their lower ends reach a given level below the upper edge of the gusset bag 60 (the edge around the opening 11) and above the open end of the tubular holders 61. At the same time, the lower part of the four wire-like members 18 are moved so as to press toward the respective lateral edges 17 from inside until the lower end of the wire-like members 18 is brought right above the upper open end of the respective tubular holders 61. The thus positioned four wire-like members 18 are moved down and inserted into the respective tubular holders 61. The upper open end of the tubular holders 61 each having the vertical wire-like member 18 is sealed by an enclosing seal 64 as shown in FIG. 14. In this way, the gusset bag 60 having the four vertical wire-like members 18 inserted into the respective tubular holders along the lateral edges 17 can be obtained easily and efficiently. All of the four wire-like members 18 can be inserted in the respective tubular holders 61. It is also possible to insert at least one, preferably two, of the four wire-like members 18 into the respective holders 16, followed by sealing the upper end of the holders 61 by an enclosing seal 64. It is also possible to integrally seal the upper end of the holders 61 and the output opening of the bag.

Figure 16:
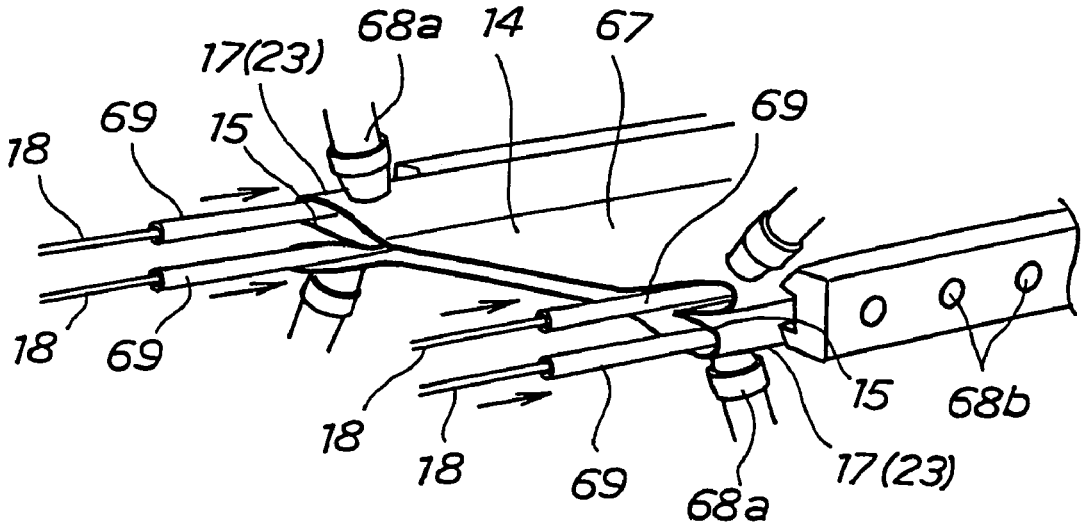
Figure 17A:
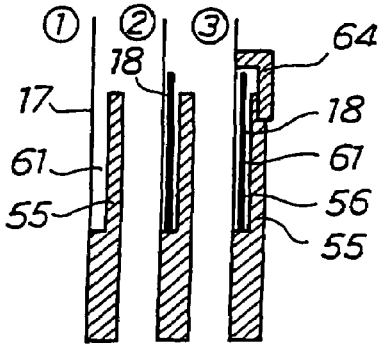
FIGS. 17(*a*)-(*d*) illustrates other ways of inserting vertical wire-like members into respective tubular holders in the production of the gusset bag of the sixth embodiment.
Figure 17C:
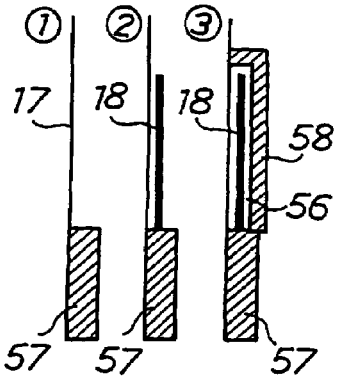
Figure 17B:
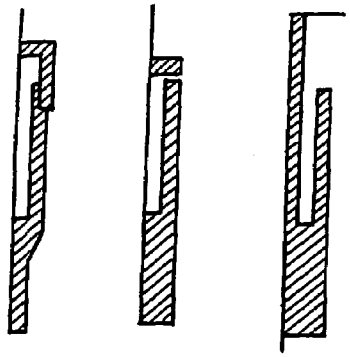
Figure 17D:
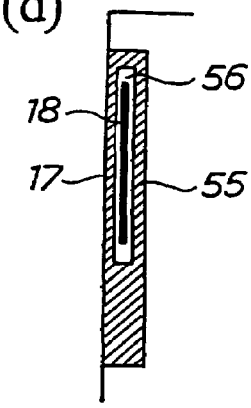

FIG. 16 shows another method of attaching plastically deform able vertical wire-like members 18 to a gusset bag 67. The method illustrated in FIG. 16 is for vertically fixing a vertical wire-like member 18 in the joints of each hem seal 23 along each lateral edge 17. First of all, the inside corners of the lateral edges 17, where the main faces 14 and the side faces 15 meet, are held open by, for example, suction with a suction unit 68*a* or air introduction into the inside corners. In this state a non-magnetic tube 69 having a magnetic wire-like member 18 inserted therein is set along each inside corner. Only the outer tubes 69, for example, a stainless tube, are pulled out of the respective inside corners while maintaining the wire-like members 18 in place by means of magnets 68*b*, such as rare earth permanent magnets, that are placed outside the lateral edges 17. The mountain fold of each lateral edge 17 is heat-sealed from both sides thereof between seal bars. Thus, each wire-like member 18 can easily be attached in the inside of the joint of the hem seal 23 along each lateral edge 17.

FIGS. 17(*a*) through (*d*) show another method of attaching a plastically deformable vertical wire-like member 18 to a bag formed of a sheet material 22 by disposing the wire-like member 18 in the fused joint formed along a lateral edge 17 of the bag. According to the method of FIG. 17(*a*), a fused joint having an open-topped tubular holder 61 is formed along, and inner side of, a lateral edge 17 by heat sealing, and a vertical wire-like member 18 is inserted in the tubular holder 61. Thereafter the upper open end of the holder 61 is heat sealed to make an enclosing seal 64. FIG. 17(*b*) illustrates other designs of the fused joint providing a tubular holder for holding a wire-like member.

According to the method of FIG. 17(*c*), a lateral edge is heat sealed to form a lower joint 57 below the position corresponding to the lower end of a vertical wire-like member 18. A vertical wire-like member 18 is vertically disposed on the top of the lower joint 57, and the part above the lower joint 57 is then heat sealed to form an L-shaped upper joint 58 to have the wire-like member 18 enclosed.

As shown in FIG. 17(*d*), a vertical wire-like member 18 can be disposed inside the joint in such a configuration that a non-fused portion 56, which is formed between a wire-like member 18 and a surrounding fused portion 55, may be formed not only on both sides (around the circumference) but also at both ends of the wire-like member 18 with some gap thereby to provide a wire-like member-absent portion. By this wire-like member-absent portion, the sheet material is prevented from being fusion bonded directly to the wire-like member 18 and from being broken through by the wire-like member 18. Since the wire-like member 18 is disposed in the fused portion 55 with the non-fused portion 56 provided around it, there is provided a small space in which the wire-like member 18 is allowed to move.

Figure 18:
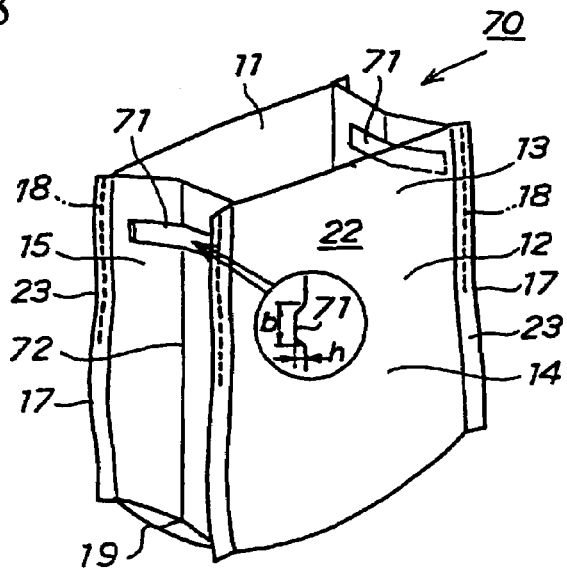
FIG. 18 is a perspective of a gusset bag having a projection according to a seventh preferred embodiment of the invention.

FIG. 18 shows a gusset bag 70 according to the seventh preferred embodiment of the present invention. In addition to the structure of the gusset bag 10 of the first embodiment, the gusset bag 70 further has a projection 71 for creating a level difference across the centerline 72 of each side face 15 and below the upper end opening 11.

The projection 71 has a strip shape with its length across the centerline 72. The projection 71 is formed by, for example, pressing the side face 15.

In the seventh embodiment, the projection 71 crossing the centerline 72 on each side face 15 is formed by pressing the upper part of the side face 15 (i.e., near the upper end opening 11) at such a position as is effective for keeping the rectangular shape of the upper end opening 11. Specifically, after a film material(s) 22 is/are shaped into a gusset bag, a part of each side face 15 is projected outward to form a projection 71 creating a level difference h (see the enlarged part of FIG. 18), e.g., of about 1 to 5 mm in the cross-section taken along the centerline 72 by a simple pressing method using a heated press having a male mold and a female mold or a seal bar having a male member and a female member set to sandwich the side face 15. In this way, the oblong rectangular projection 71 having a width b, e.g., of about 3 to 15 mm can easily be formed.

The gusset bag 70 of the seventh embodiment is filled with a powdered detergent to provide a detergent package similarly to the gusset bag 10 of the first embodiment. A user cuts off the top seal of the package to make an upper end output opening 11, through which the user can weigh out the detergent. The structure of the seventh embodiment is effective to keep the upper end output opening 11 wide while a user is taking out the detergent. In more detail, when the gusset bag 70 with the contents is opened, the folded side faces 15 are unfolded by, for example, pressing the centerline 72 or its vicinity outward. In this state, the projection 71 effectively prevents the side face from returning to its original V-folded state. Accordingly, the output opening 11 can effectively be kept wide to have the same size as the bottom 19 while the detergent is being taken out.

According to the seventh embodiment, the upper end output opening 11 can be kept wide by such a simple structure and such a simple operation, making it easier for a user to take out a requisite amount of the detergent smoothly.

Figure 19:
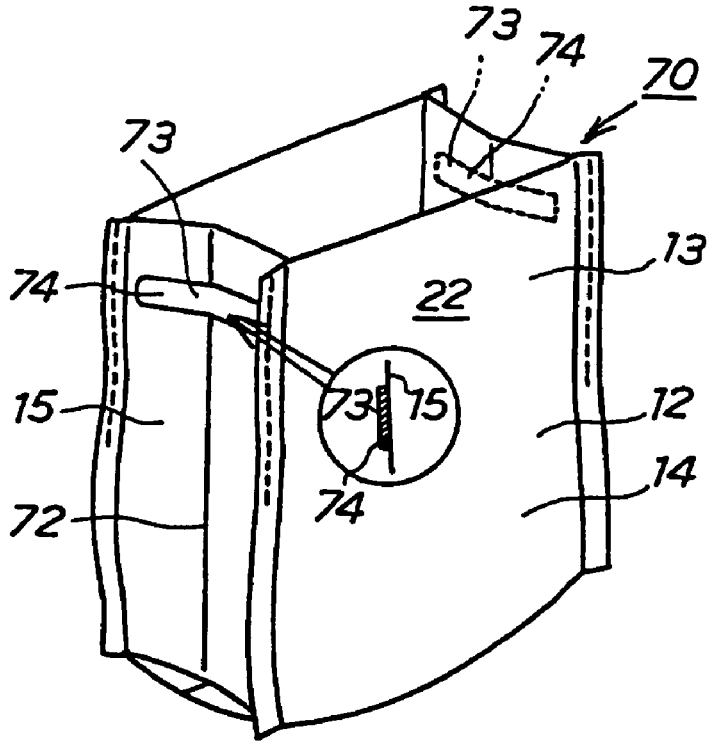
FIG. 19 is a perspective showing another projection according to the seventh embodiment.

FIG. 19 shows a modification of the projection (for creating a level difference) of the gusset back 70 according to the seventh embodiment. The gusset back 70 shown in FIG. 19 has a narrow width piece 74 of a sheet material stuck to each side face 15 with its length intersecting with the centerline 72 to form a projection 73. The piece 74 includes a tack label that can be adhered to either the outer or the inner surface of the sheet material 22 forming the face sides 15 by heat sealing or with an adhesive, etc. to easily form the projection 73.

Figure 20:
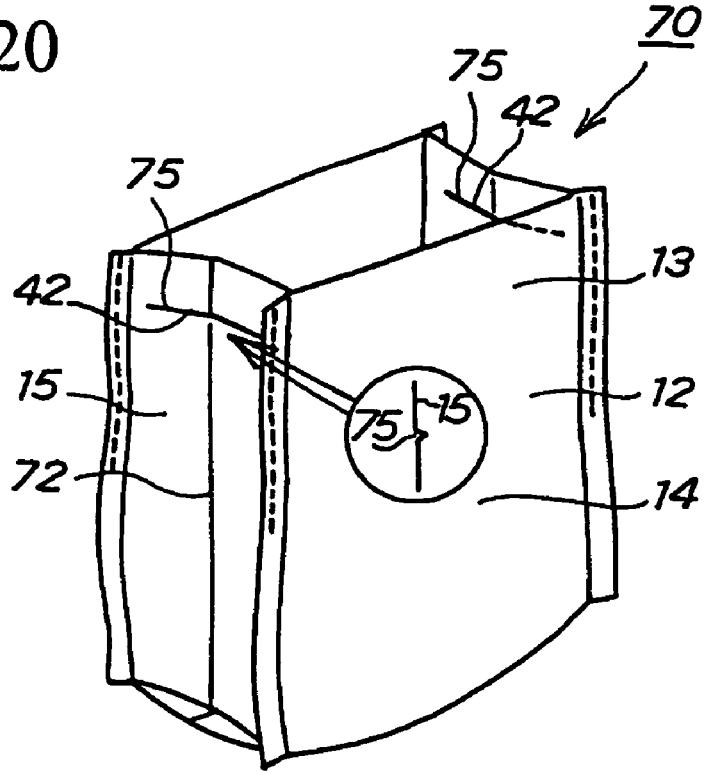
FIG. 20 is a perspective showing still another projection according to the seventh embodiment.

FIG. 20 shows still another modification of the projection of the gusset back 70 according to the seventh embodiment. In this modification, a linear portion is provided across the centerline 72 to form a projection 75. The projection 75 projects either on the outer or the inner surface of the sheet material 22 forming the side faces 15. The cross-section of the projection 75 includes a triangle and a half circle. The projection 75 can easily be formed by, for example, pressing each side face 15. The pressing is carried out by means of a press having a male mold and a female mold or a heat seal bar in the same manner as for the projection 71 shown in FIG. 18.

The projections 73 and 75 produce the same effect as described above, effectively preventing the unfolded side faces 15 from restoring their V-folded state.

Figure 21A:
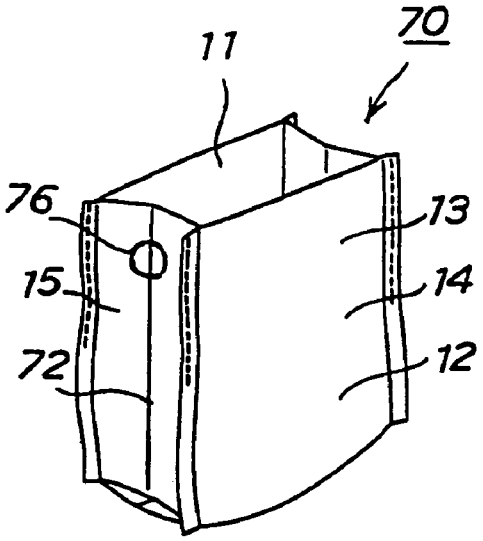
FIGS. 21(*a*) and 21(*b*) each show yet another projection according to the seventh embodiment.
Figure 21B:
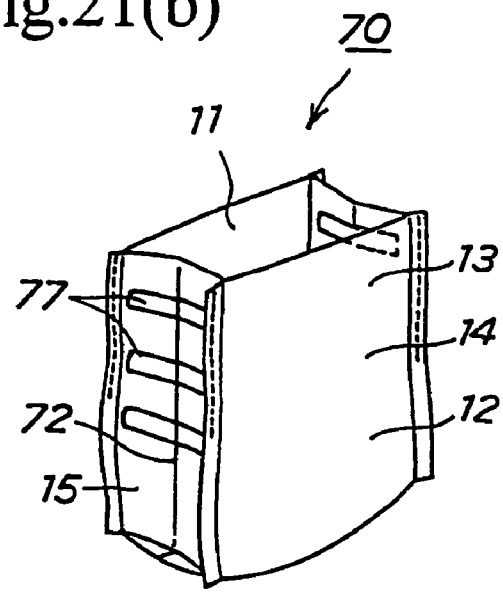

The shape and structure of the projection for creating a level difference according to the seventh embodiment are not limited to those of the projections 71, 73, and 75 as long as the projection crosses the centerline 72 of each side face 15. For instance, as shown in FIG. 21(*a*), a circular projection 76 may be formed across the centerline 72. As shown in FIG. 21(*b*), a plurality of projections 77 can be provided at intervals in the vertical direction. In this case, even if a user cuts off the upper part of the output opening side portion 13 after a considerable amount of the contents is consumed, the function of maintaining the rectangular shape of the output opening is exerted by the lower projection 77. The projection for creating a level difference may have a bent to make the shape, e.g., of "V" or a curve to make the shape, e.g., of an arc.

Figure 22:
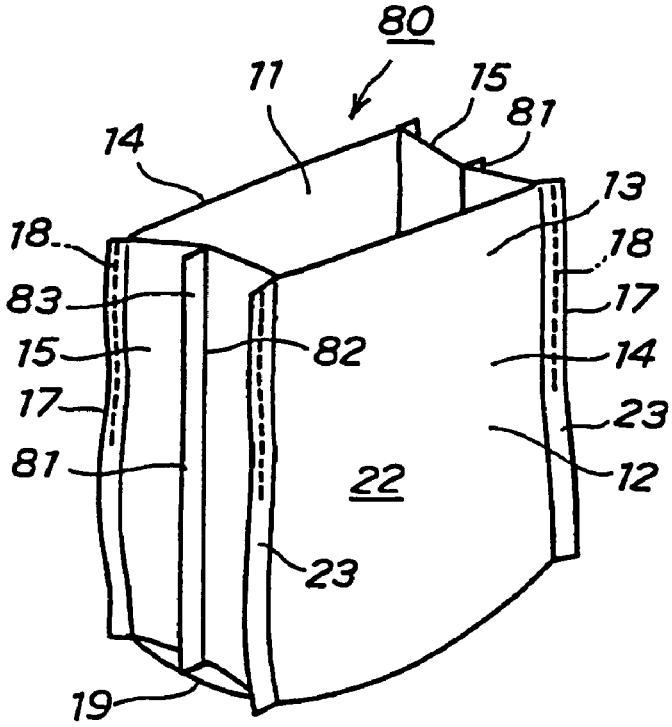
FIG. 22 is a perspective of a gusset bag having a fin-like rib according to an eight preferred embodiment of the invention.

FIG. 22 shows a gusset bag 80 according to the eighth preferred embodiment of the present invention. In addition to the structure of the gusset bag 10 of the first embodiment, the gusset bag 80 has a narrow fin-like rib 81 projecting on the outer side of each side face 15 along the centerline 82. The rib 81 is formed by folding back a narrow longitudinal area 83 of the sheet material 22 symmetric about the centerline 82 to make a mountain fold and adhering the facing inner sides of the narrow area 83 to each other.

The rib 81 extends from the top edge making the upper end output opening 11 to the bottom 19 of the bag 80.

Specifically, the rib 81 of the eighth embodiment is preferably formed as follows. After shaping the sheet material 22 into a gusset bag shape, the narrow longitudinal area 83 symmetric about the centerline 82 on the outer side of the side face 15 is folded back along the centerline 82, and the facing inner sides (the facing sealable layers) of the folded area 83 are joined together by, for example, heat sealing from the outer side. There is thus formed with ease a long and narrow fin-like rib 81 having a width of about 5 to 10 mm and extending from the top edge to the bottom of the bag.

The gusset bag 80 of the eighth embodiment is filled with a powdered detergent to provide a detergent package similarly to the gusset bag 10 of the first embodiment. A user cuts off the top seal of the package to make an upper end output opening 11, through which the user can weigh out the detergent. The structure of the eighth embodiment makes it possible to keep the output opening 11 wide by a simple operation while a user is taking out the detergent. In more detail, when a user opens the top of the gusset bag 80, she or he opens the folded side faces 15, picks the rib 81, and pull the rib 81 outward. In this manner, the V-fold of the side faces 15 can easily be stretched flat. In this state, the ribs 81 resist the V-crease along the centerline 82 and effectively serve to prevent the side faces 15 from restoring the V-fold. Thus, the opening 11 can easily be kept wide with the same size as the bottom 19 while the detergent is being taken out.

Accordingly, the gusset bag 80 of the eighth embodiment is structurally simple and yet designed to make a wide upper end output opening 11 by a simple opening operation and to keep it wide enough for a user to take out the detergent more easily and more smoothly.

Figure 23:
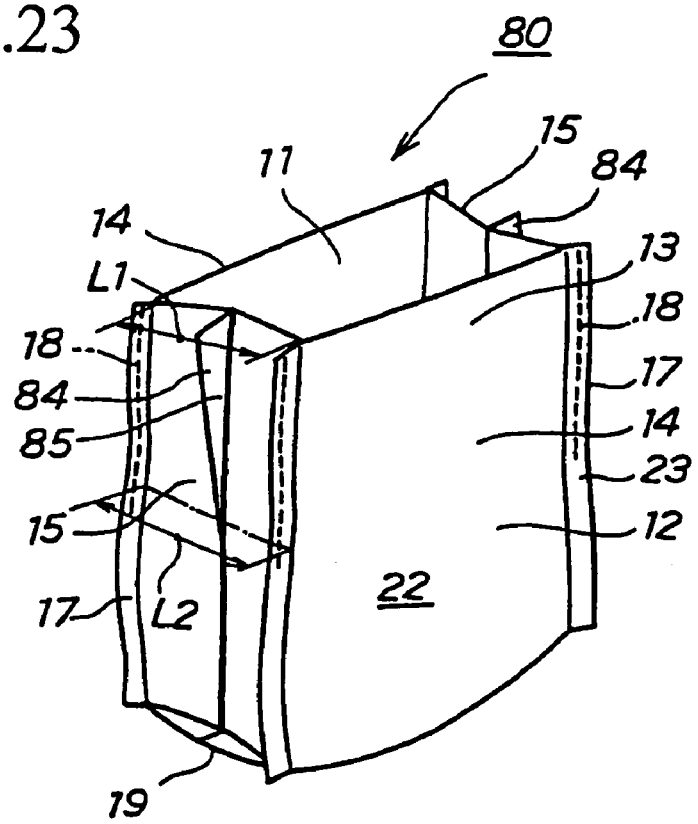
FIG. 23 is a perspective showing another fin-like rib according to the eighth embodiment.

FIG. 23 represents a modification of the fin-like rib of the gusset bag 80 according to the eighth embodiment. The gusset bag 80 of FIG. 23 has an elongated triangular fin-like rib 84 projecting on the outer surface of each side face 15 over a length from the top edge of the opening 11 downward. The triangular rib 84 is provided on only almost the upper half of the gusset bag 80. In the same manner as for the rib 81, the rib 84 can easily be formed by folding the upper half of the side face 15 along the centerline to make an elongated triangle 85 projecting outward and heat sealing the facing inner sides of the triangle 85 from the outer side.

The rib 84 produces the same effect as the rib 81. That is, the rib 84 resists the crease along the centerline and effectively prevents the side face 15 from restoring the V-fold. Since the rib 84 shown in FIG. 23 decreases in width in the downward direction to make a triangle, when the gusset bag 80 is opened, the width L1 of the side face 15 at the top edge is smaller than the width L2 of the side face 15 at the lower end of the rib 84. As a result, the widely opened state of the upper end output opening 11 can be maintained more effectively.

Formation of the fin-like rib by bonding the inner side of the outward fold does not always need to follow shaping the sheet material 22 into a bag. That is, the fin-like rib may be formed at a predetermined position before shaping the sheet material 22. The vertical position of the fin-like rib is not always from the top edge downward but may be selected appropriately so as to exert the above-mentioned effects.

Figure 24A:
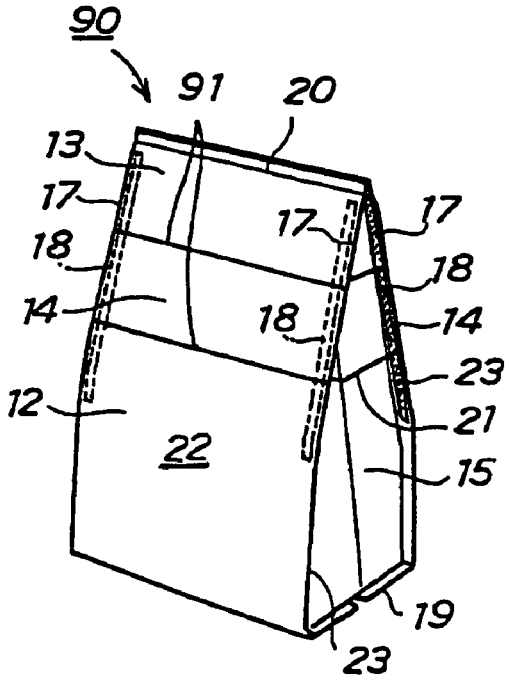
FIG. 24(*a*) is a perspective of a gusset bag with contents (package) according to a ninth preferred embodiment of the invention.
Figure 24B:
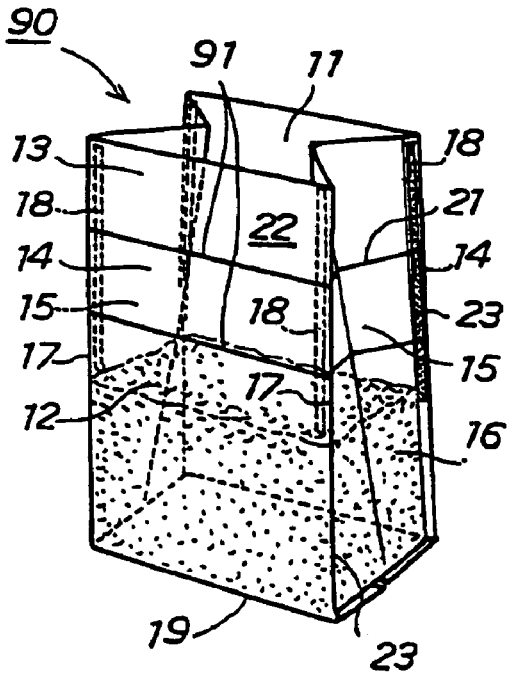

FIGS. 24(*a*) and 24(*b*) show a gusset bag 90 according to the ninth preferred embodiment of the present invention. In addition to the structure of the gusset bag 10 of the first embodiment, the gusset bag 90 of the ninth embodiment is provided with at least one cutting guide line 91 for cutting the bag at a certain position intersecting the vertical wire-like members 18 on at least one of the main faces 14, and the vertical wire-like members 18 are capable of being cut at the position intersecting the cutting guide line 91.

In the embodiment shown in FIG. 24, the gusset bag 90 is provided with a plurality of such cutting guide lines 91 at intervals in the vertical direction.

In the ninth embodiment, the vertical wire-like members 18 are each previously cut at the position intersecting the cutting guide line 91 and therefore attached discontinuously. The vertical wire-like member 18 can be attached discontinuously by providing a wire-like member-absent portion at the intersection of the cutting guide line 91 and the lateral edge. The wire-like member-absent portion preferably has a seal for sealing the upper and lower cut pieces of the wire-like member 18 within the respective fused portions.

The cutting guide line 91 for cutting the bag 90 at a certain height is, for example, tear tape that is adapted to be pulled to laterally tear the gusset bag 90. Such tear tape includes the one disclosed in JP-A-2000-142726, which is glued to the interior whole circumference of a film that forms a package.

The cutting guide line 91 made of the tear tape is continuously provided on the whole circumference of the gusset bag 10 including the pair of main faces 14 and the pair of side faces 15. In FIGS. 24(*a*) and 24(*b*), two pieces of the tear tape are provided apart from each other in the upper half of the gusset bag 90. The number of the cutting guide lines 91 may be one or three or even more.

The gusset bag 90 of the ninth embodiment is filled with a powdered contents 16 to provide a detergent package similarly to the gusset bag 10 of the first embodiment. A user cuts off the top seal of the package to make an upper end output opening 11, through which the user can weigh out the detergent. The structure of the ninth embodiment produces not only the same effects as the gusset bag 10 of the first embodiment but also the effect that the gusset bag continues giving a user ease of taking out the detergent even after the amount of the contents 16 has decreased.

Each time the contents 16 is used, the gusset bag 90 is re-opened to make the output opening 11 supported by the vertical wire-like members 18 and re-closed by folding back the output opening side portion 13. As the height of the contents 16 decreases gradually with repeated use, the vacant space in the gusset bag 90 increases, that is, the distance from the output opening 11 to the detergent level increases. Since the gusset bag 90 has the cutting guide lines 91 within the height intersecting the vertical wire-like members 18, the upper part of the gusset bag 90 can be cut off along the cutting guide lines 91 successively when necessary. As a result, the level of the output opening 11 can be lowered closer to the detergent level thereby keeping the ease of taking out the detergent while maintaining the re-opening and re-closing function of the vertical wire-like members 18.

Figure 25:
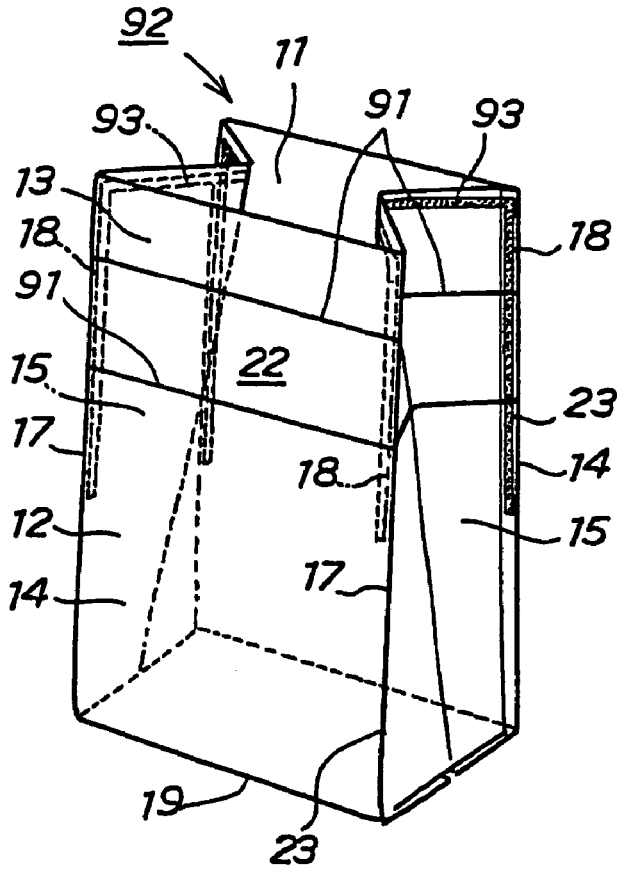
FIG. 25 is a perspective of a gusset bag according to a tenth preferred embodiment of the invention with its upper end open.

FIG. 25 shows a gusset bag 92 according to the tenth preferred embodiment of the present invention. In addition to the structure of the gusset bag 90 of the ninth embodiment, the gusset bag 92 further has a plastically deformable lateral wire-like member 93 attached to each side face 15 to substantially form the shape of an inverted angular "U" together with the pair of the vertical wire-like members 18 on that side face 15.

According to the tenth embodiment, the following effect is obtained in addition to the effects of the ninth embodiment. When the output opening side portion 13 is opened to make the upper end output opening 11, the lateral wire-like members 93 are unbent straight to help the inward V-folded side faces 15 be stretched flat and keep the side faces 15 in the stretched state, thereby to retain the rectangular opening 11 easily. Thus, the gusset bag 92 is easier and more efficient for a user to take out the contents 16.

The present invention is not limited to the aforementioned embodiments, and various changes and modifications can be made therein as described below without departing from the spirit and scope thereof. For example, the bag according to the present invention includes pouches, standing pouches, and gusset bags. The hem seals along the lateral edges of the bag may be either an edge joined together formed by joining edges of two sheet materials or opposite edges of a sheet material or folded back formed by folding back a sheet material. The bag does not always need to have a wire-like member in all of its lateral edges. The sheet material fabricating the gusset bag is not limited to the multi-layered composite sheet containing an aluminum foil layer, and an aluminum-free composite sheet material and a single layered sheet material are useful as well. For example, films of polyolefin resins, polyvinyl chloride, polyester resins, polyamide resins, etc. may be used either alone or in the form of a composite film. The contents that are put in the gusset bag is not limited to a powdered detergent but include liquids such as shampoos and rinses, solids such as snacks, and various other products. The wire-like members can also be attached by adhesion with a tack seal, an adhesive, etc. or by welding. The wire-like members are not limited to metal wire. The gusset bag does not always need to have hem seals.

Figure 26:
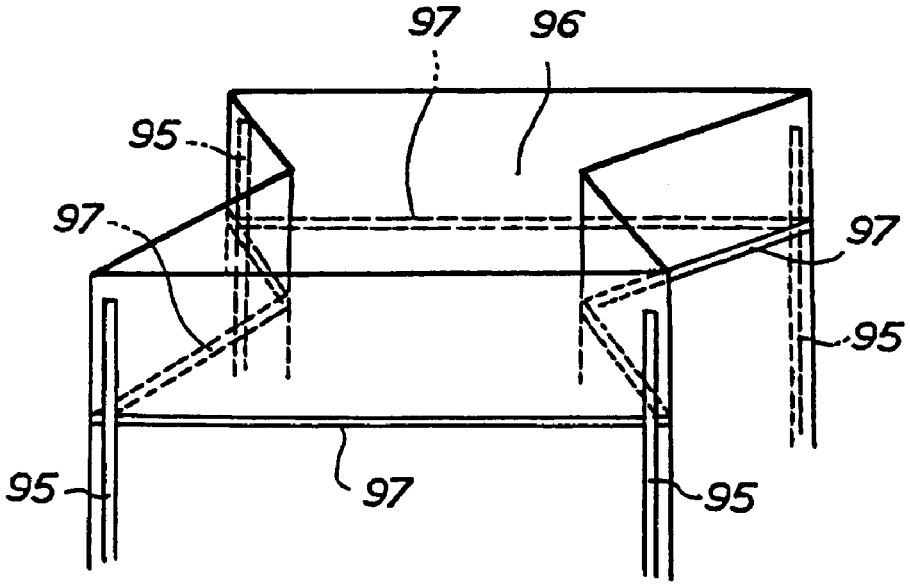
FIG. 26 is a partial perspective of a gusset bag according to another preferred embodiment of the invention.

As shown in FIG. 26, the gusset bag of the present invention can have a loop of a plastically deformable wire-like member 97 that is folded into a rectangle substantially the same as the rectangular upper end opening 96 through which the contents are taken out. According to this modification, the upper end opening 96 is kept wide in a more stable manner. Attachment of the vertical wire-like member along each of the four lateral edges (corners) can also be carried out by preparing a cut sheet of substantially the same size and shape as the main faces, attaching a vertical wire-like member on each side edge of the cut sheet, and applying the cut sheet to the inner side of each of the main faces.

Where the gusset bag of the present invention has a hem seal at each lateral edge, the vertical wire-like members may be provided between the facing sides forming the respective hem seals. In this modification, the vertical wire-like members and related members used to attach the vertical wire-like members are hidden from the sight to give an improved appearance to the gusset bag on shelf and in use. The vertical and the lateral wire-like members can also be attached by adhering with a tack seal, an adhesive, etc. or welding.

Figure 27A:
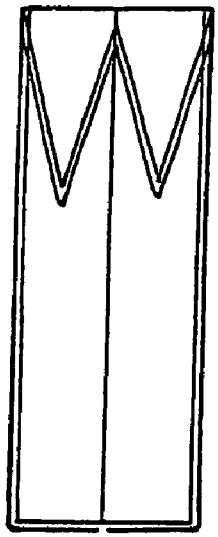
FIG. 27(*a*), FIG. 27(*b*), and FIG. 27(*c*) are each a side view of a gusset bag of the invention, showing another preferred arrangement of a wire-like member.
Figure 27B:
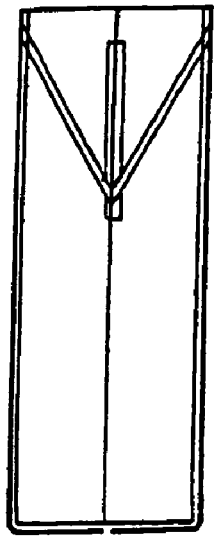
Figure 27C:
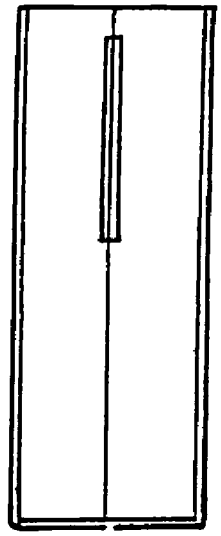

FIGS. 27(*a*), 27(*b*), and 27(*c*) represent other patterns of arranging wire-like members on each side face. As shown in FIG. 27(*a*), a wire-like member may be disposed in the shape of a "W" symmetrical about the centerline of each side face. The V-shaped wire-like member may be arranged in combination with an additional wire-like member, for example, one vertically attached along the centerline as shown in FIG. 27(*b*). Where a wire-like member is attached vertically along the centerline of each side face as shown in FIG. 27(*c*), such a vertically attached wire-like member makes no contribution to holding the upper end opening of the gusset bag wide. Nevertheless, when the gusset bag is re-closed by folding back the output opening side portion, since the pair of the side faces are folded inward, the vertical wire-like members are held in between the pair of the main faces and therefore contribute to keeping the re-closed state more stably.

Figure 28A:
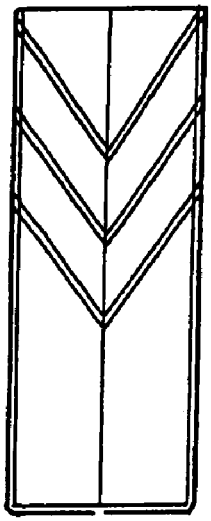
FIG. 28(*a*), FIG. 28(*b*), and FIG. 28(*c*) are each a side view of a gusset container another embodiment of the invention, showing other preferred arrangement of a plurality of wire-like members.
Figure 28B:
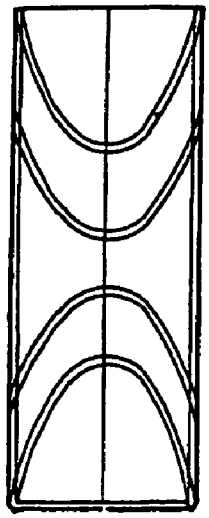
Figure 28C:
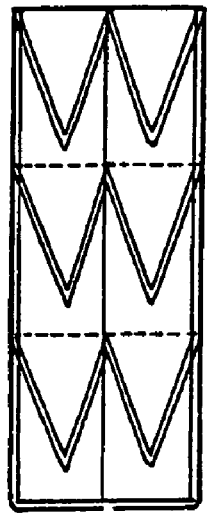
Figure 29A:
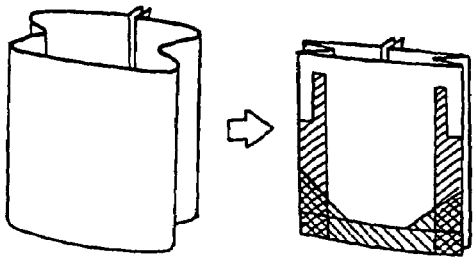
FIG. 29(*a*), FIG. 29(*b*), FIG. 29(*c*), FIG. 29(*d*), FIG. 29(*e*), and FIG. 29(*f*) each present a perspective illustrating the configuration of a bag to which plastically deformable vertical wire-like members are to be attached along the lateral edges.
Figure 29B:
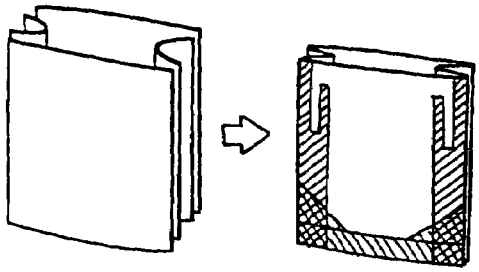
Figure 29C:
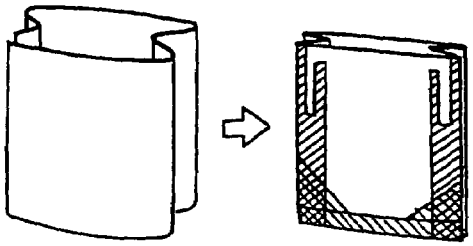
Figure 29D:
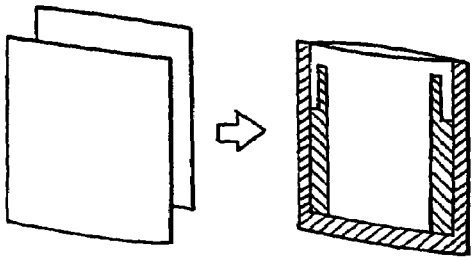
Figure 29E:
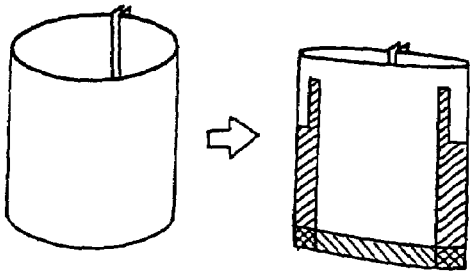
Figure 29F:
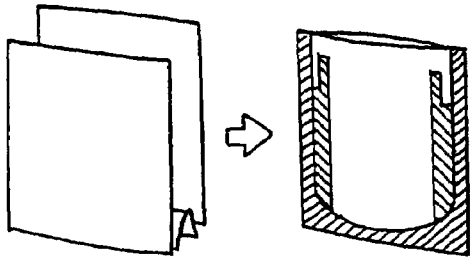

Furthermore, a plurality of wire-like members may be arranged at intervals in the height direction on each side face as shown in FIGS. 28(*a*), 28(*b*), and 28(*c*). In these cases, a cutting guide line may be provided in the interval as shown in FIG. 28(*c*), along which the upper part of the gusset bag can be cut off according as the contents decrease.

The tubular holders and the vertical wire-like members should be provided at least over a length from the output opening side portion to the body portion. They may be provided over the whole length of the lateral edges. The tubular holders do not always need to be formed in the hem seals.

The bag made of at least one sheet material, to the lateral edge of which is vertically attached a plastically deformable wire-like member, does not always need to be a gusset bag whose four lateral edges are folded back hem seals as shown in FIG. 29(*a*). For example, the bag of the present invention includes a gusset bag having at least one hem seal formed by joining two edges of a sheet material(s) (see FIGS. 29(*b*) and 29(*c*)), a three side sealed bag (see FIG. 29(*d*)), a pillow bag (see FIG. 29(*e*)), and a standing pouch (see FIG. 29(*f*)). A wire-like member is vertically disposed in the fused joint of the folded back hem seal or the edge joined hem seal formed along the lateral edge of these bags. Preferably, a tubular holder is formed in the joint, in which a wire-like member is vertically inserted. The bag does not always need to have a wire-like member attached to each of the lateral edges thereof. While a wire-like member can be attached to any lateral edge, it is preferably attached to at least two lateral edges on the same main face, either the front face or the rear face.

Figure 30A:
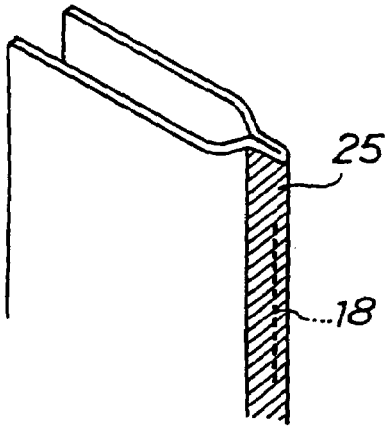
FIG. 30(*a*) is a fragmentary perspective showing a folded back hem seal formed along a lateral edge of a bag, with a plastically deformable vertical wire-like member disposed inside the joint of the hem seal.
Figure 30B:
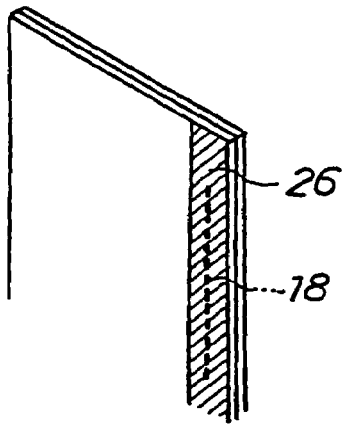
Figure 31A:
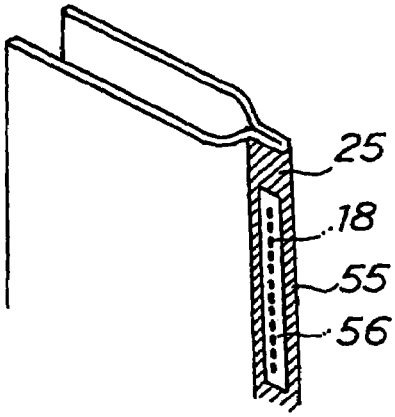
FIG. 31(*a*) is a fragmentary perspective showing a folded back hem seal formed along a lateral edge of a bag, inside the fused joint of which is disposed a plastically deformable vertical wire-like member while the portion around the wire-like member is left non-fused.
Figure 31B:
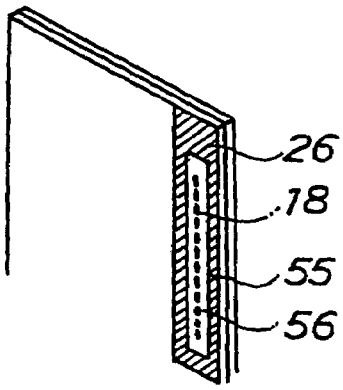

More specifically, a plastically deformable wire-like member 18 can be vertically attached inside a completely fused joint of a folded back hem seal 25 or an edge joined hem seal 26 formed along a lateral edge as shown in FIG. 30(*a*) or 30(*b*), respectively. A wire-like member 18 can also be disposed inside a joint of the hem seal 25 or 26 with a non-fused portion 56 left therearound as shown in FIGS. 31(*a*) and 31(*b*). In this case, the sheet material 22 is prevented from being fusion bonded directly to the wire-like member 18 and from being broken through by the wire-like member 18. In fixing a wire-like member 18 covered with a resin to a bag by heat sealing, cases sometimes occur in which the resin melts to reduce the flexural durability of the wire-like member 18 or to impair the appearance of the bag. Moreover, where a plastically deformable wire-like member 18 is made of a thermoplastic resin, there is a fear that the shape retention of the wire-like member is ruined by the heat sealing. The above-described embodiment in which the portion around the wire-like member 18 is left non-fused is effective in averting such disadvantages. In addition, the wire-like member 18 is allowed to move vertically to some extent within the space of the non-fused portion 56. This means that the bending position of the wire-like member 18 is shifted slightly even if the bag is repeatedly folded back at the same position, which brings about improved durability against bending.

Figure 32A:
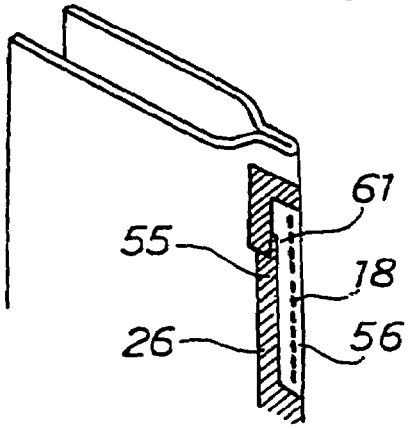
FIG. 32(*a*) is a fragmentary perspective showing a folded back hem seal formed along a lateral edge of a bag so as to form a tubular holder inside the hem joint, in which holder a vertical wire-like member is inserted.
Figure 32B:
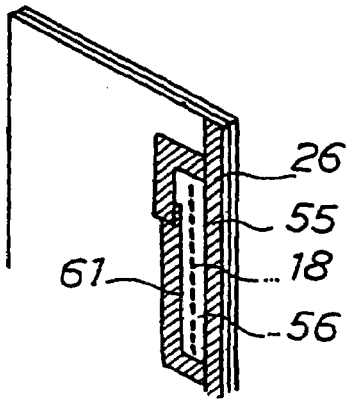

A wire-like member 18 can also be attached to a bag by forming a tubular holder 61 in a joint and then inserting the wire-like member 18 in the holder 61 as shown in FIGS. 32(*a*) and 32(*b*).

When the joint in which a wire-like member 18 is disposed is of a folded back hem seal 25, fixing of the wire-like member 18 in the joint along the outermost edge of the hem is more easily achieved with reduced care not to stick outside or inside of the joint as compared with when the joint is of an edge joined hem seal 26. Additionally, the heat seal width can be narrowed, the production is easier, and the bag's appearance is neater.

The invention claimed is:

1. A bag formed of a sheet material, comprising:

a plastically deformable wire-like member attached exclusively along a lateral edge of said bag, the lateral edge having a hem seal formed by heat sealing, the wire-like member being disposed inside a fused joint of a folded back hem seal of said bag with a non-fused portion left between the wire-like member and a surrounding fused portion of the hem seal, wherein said vertical wire-like member is disposed along the lateral edge inside said folded back hem seal joint such that the folded back hem seal joint is positioned at a top end, at a bottom end, and on at least one side of the vertical wire-like member so as to leave a space from a fused portion of said joint and is disposed exclusively along an upper portion of the hem seal joint of said bag.

2. The bag according to claim 1, wherein the joint has formed therein a tubular holder for holding said wire-like member, and wherein the wire-like member is inserted in the holder.

3. The bag according to claim 1, wherein the wire-like member is covered with a resin.

4. A detergent package comprising a powdered or granular detergent packed in the bag according to claim 1.

5. The bag according to claim 1, wherein at least one main face of the bag is provided with a cutting guide line along which an upper part of the bag is adapted to be cut off, the cutting guide line intersecting with the vertical wire-like member, and the vertical wire-like member is adapted to be cut off along the cutting guide line.

6. The bag according to claim 1, wherein the bag includes four of the lateral edges and at least two of the lateral edges each include the plastically deformable wire-like member disposed along the lateral edge.

7. The bag according to claim 1, wherein the bag includes four of the lateral edges and each of the four lateral edges include the plastically deformable wire-like member disposed along the lateral edge.

8. A gusset bag, comprising:

a pair of main faces and a pair of inward folding side faces being adapted to be opened at a top portion of said gusset bag for taking out contents of the gusset bag while self-standing;

a deformable vertical wire-like member vertically attached along each lateral edge of said gusset bag that is an intersection of adjacent main and side faces over a length from an output opening side portion to a body portion of the gusset bag and is disposed along an upper portion of said gusset bag such that the vertical wire-like member does not extend to a top edge of the gusset bag; and a lateral wire-like member laterally attached to each of the side faces to substantially form the shape of an inverted angular "U" together with a pair of the vertical wire-like members when the pair of main faces is not folded and the pair of side faces is folded inwardly.

9. The gusset bag according to claim 5 wherein at least one of the main faces is provided with a cutting guide along which an upper part of the gusset bag is adapted to be cut off, the cutting guide line intersecting with the vertical wire-like members, and the vertical wire like members are adapted to be cut off along the cutting guide line.

10. A bag formed of a sheet material, comprising:

a plastically deformable wire-like member attached exclusively along a lateral edge of said bag, the wire-like member being disposed inside a fused joint of a folded back hem seal of said bag formed along the lateral edge such that the wire-like member does not extend to a top edge of the bag; and a rectangular projection which extends along side faces of said bag for maintaining a rectangular shape of said bag upon being open, wherein the wire-like member is disposed exclusively along an upper portion of the hem seal joint of the bag.

11. A bag formed of a sheet material, comprising:

a plastically deformable wire-like member attached exclusively along a lateral edge of said bag, the lateral edge having a hem seal formed by heat sealing, the wire-like member being disposed inside a fused joint of a folded back hem seal of said bag with a non-fused portion left between the wire-like member and a surrounding fused portion of the hem seal, wherein said wire-like member is disposed along the lateral edge inside said folded back hem seal joint such that the folded back hem seal joint is positioned at a top end, at a bottom end, and on at least one side of the wire-like member so as to leave a space from a fused portion of said joint and is disposed exclusively along an upper portion of the hem seal joint of said bag; and a tubular holder for holding said wire-like member wherein a portion free of said wire-like member of said bag configured for forming an open space of said bag is provided between a top edge of said bag around an opening of said bag and an upper open end of said tubular holder.

12. The bag according to claim 11, wherein at least one main face of the bag is provided with a cutting guide line along which an upper part of the bag is adapted to be cut off, the cutting guide line intersecting with the vertical wire-like member, and the vertical wire-like member is adapted to be cut off along the cutting guide line.

* * * * *

UNITED STATES PATENT AND TRADEMARK OFFICE

CERTIFICATE OF CORRECTION

PATENT NO. : 7,665,895 B2
APPLICATION NO. : 10/824539
DATED : February 23, 2010
INVENTOR(S) : Takita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 891 days.

Signed and Sealed this

Seventh Day of December, 2010

David J. Kappos

David J. Kappos
*Director of the United States Patent and Trademark Office*